US010221629B2

(12) United States Patent
Can et al.

(10) Patent No.: US 10,221,629 B2
(45) Date of Patent: Mar. 5, 2019

(54) POLYCRYSTALLINE SUPER HARD CONSTRUCTION AND A METHOD FOR MAKING SAME

(71) Applicant: Element Six Limited, Country Clare (IE)

(72) Inventors: Nedret Can, Oxfordshire (GB); Habib Saridikmen, Oxfordshire (GB); Roger William Nigel Nilen, Oxfordshire (GB); Michael L. Doster, Houston, TX (US); Anthony A. DiGiovanni, Houston, TX (US); Matthew R. Isbell, Houston, TX (US); Nicholas J. Lyons, Houston, TX (US); Derek L. Nelms, Houston, TX (US); Danny E. Scott, Houston, TX (US)

(73) Assignee: Element Six Limited, County Clare (IE)

( * ) Notice: Subject to any disclaimer, the term of this patent is extended or adjusted under 35 U.S.C. 154(b) by 0 days.

(21) Appl. No.: 14/440,795

(22) PCT Filed: Nov. 5, 2013

(86) PCT No.: PCT/EP2013/073034

§ 371 (c)(1),
(2) Date: May 5, 2015

(87) PCT Pub. No.: WO2014/068137

PCT Pub. Date: May 8, 2014

(65) Prior Publication Data

US 2015/0292272 A1 Oct. 15, 2015

Related U.S. Application Data

(60) Provisional application No. 61/722,705, filed on Nov. 5, 2012.

(30) Foreign Application Priority Data

Nov. 5, 2012 (GB) ..... 1219882.6

(51) Int. Cl.
*B24D 3/02* (2006.01)
*C09C 1/68* (2006.01)
(Continued)

(52) U.S. Cl.
CPC ..... *E21B 10/567* (2013.01); *B22F 3/14* (2013.01); *B24D 3/06* (2013.01); *C22C 26/00* (2013.01);
(Continued)

(58) Field of Classification Search
None
See application file for complete search history.

(56) References Cited

U.S. PATENT DOCUMENTS 7,971,663 B1 * 7/2011 Vail ..... B01J 3/062 175/428
8,162,082 B1 4/2012 Gonzalez et al.
(Continued)

FOREIGN PATENT DOCUMENTS

WO WO 2010097783 A1 * 9/2010 ..... C22C 26/00
WO 2012145586 A1 10/2012
WO WO 2012145586 A1 * 10/2012 ..... B22F 7/08

OTHER PUBLICATIONS

PCT International Search Report and Written Opinion issued for PCT/EP2013/073034, dated Feb. 6, 2014 (12 pages).
(Continued)

*Primary Examiner* — Colleen P Dunn
*Assistant Examiner* — Ross J Christie
(74) *Attorney, Agent, or Firm* — Armstrong Teasdale LLP

(57) ABSTRACT

A polycrystalline super hard construction has a body of PCD material and a plurality of interstitial regions between inter-
(Continued)

bonded diamond grains forming the PCD material. The body also has a first region substantially free of a solvent/catalyzing material which extends a depth from a working surface into the body of PCD material. A second region remote from the working surface includes solvent/catalyzing material in a plurality of the interstitial regions. A chamfer extends between the working surface and a peripheral side surface of the body of PCD material. The chamfer has a height which is the length along a plane perpendicular to the plane along which the working surface extends between the point of intersection of the chamfer with the working surface and the point of intersection of the chamfer and the peripheral side surface of the body of PCD material. The depth of the first region is greater than the height of the chamfer. A first length along a plane extending from the point of intersection of the chamfer and the peripheral side edge of the PCD body at an angle of between around 65 to 75 degrees to the interface between the first and second regions is between around 60% to around 300% of the depth of the first region.

21 Claims, 10 Drawing Sheets

(51) Int. Cl.

| | |
|---|---|
| ***C09K 3/14*** | (2006.01) |
| ***E21B 10/567*** | (2006.01) |
| ***B22F 3/14*** | (2006.01) |
| ***C22C 26/00*** | (2006.01) |
| ***B24D 3/06*** | (2006.01) |
| *B22F 3/24* | (2006.01) |
| *B22F 5/00* | (2006.01) |

(52) U.S. Cl.
CPC ... *B22F 2003/244* (2013.01); *B22F 2005/001* (2013.01); *B22F 2998/10* (2013.01)

(56) References Cited

U.S. PATENT DOCUMENTS

| | | | | |
|---|---|---|---|---|
| 2006/0157285 | A1* | 7/2006 | Cannon | E21B 10/36 175/374 |
| 2010/0266816 | A1* | 10/2010 | Eyre | C22C 26/00 428/157 |
| 2010/0300765 | A1* | 12/2010 | Zhang | E21B 10/5673 175/428 |
| 2011/0036641 | A1* | 2/2011 | Lyons | E21B 10/5735 51/295 |
| 2011/0042149 | A1 | 2/2011 | Scott et al. | |
| 2011/0067929 | A1* | 3/2011 | Mukhopadhyay | B01J 3/062 51/307 |
| 2011/0174549 | A1* | 7/2011 | Dolan | E21B 10/5676 175/428 |
| 2011/0266059 | A1 | 11/2011 | DiGiovanni et al. | |
| 2012/0012401 | A1 | 1/2012 | Gonzalez et al. | |
| 2012/0261197 | A1* | 10/2012 | Miess | B01J 3/062 51/307 |

OTHER PUBLICATIONS

Combined Search and Examination Report issued for GB1219882.6, dated Apr. 26, 2013 (8 pages).

* cited by examiner

Contrast Level - Same criteria threshold
[IN NEGATIVE]

Diamond Intensity: 0

Diamond Intensity: 15

POLYCRYSTALLINE SUPER HARD CONSTRUCTION AND A METHOD FOR MAKING SAME

CROSS-REFERENCE TO RELATED APPLICATIONS

This application is a National Stage of International Application No. PCT/EP2013/073034, filed Nov. 5, 2013, which claims priority to GB1219882.6, filed Nov. 5, 2012 and claims the benefit of U.S. Provisional Application 61/722,705, filed Nov. 5, 2012.

FIELD

This disclosure relates to a polycrystalline super hard construction comprising a body of polycrystalline diamond (PCD) material and a method of making a thermally stable polycrystalline diamond construction.

BACKGROUND

Cutter inserts for machining and other tools may comprise a layer of polycrystalline diamond (PCD) bonded to a cemented carbide substrate. PCD is an example of a super hard material, also called super abrasive material.

Components comprising PCD are used in a wide variety of tools for cutting, machining, drilling or degrading hard or abrasive materials such as rock, metal, ceramics, composites and wood-containing materials. PCD comprises a mass of substantially inter-grown diamond grains forming a skeletal mass which defines interstices between the diamond grains. PCD material typically comprises at least about 80 volume % of diamond and may be made by subjecting an aggregated mass of diamond grains to an ultra-high pressure of greater than about 5 GPa, typically about 5.5 GPa, and temperature of at least about 1200° C., typically about 1440° C., in the presence of a sintering aid, also referred to as a catalyst material for diamond. Catalyst materials for diamond are understood to be materials that are capable of promoting direct inter-growth of diamond grains at a pressure and temperature condition at which diamond is thermodynamically more stable than graphite.

Catalyst materials for diamond typically include any Group VIII element and common examples are cobalt, iron, nickel and certain alloys including alloys of any of these elements. PCD may be formed on a cobalt-cemented tungsten carbide substrate, which may provide a source of cobalt catalyst material for the PCD. During sintering of the body of PCD material, a constituent of the cemented-carbide substrate, such as cobalt in the case of a cobalt-cemented tungsten carbide substrate, liquefies and sweeps from a region adjacent the volume of diamond particles into interstitial regions between the diamond particles. In this example, the cobalt acts as a catalyst to facilitate the formation of bonded diamond grains. Optionally, a metal-solvent catalyst may be mixed with diamond particles prior to subjecting the diamond particles and substrate to the HPHT process. The interstices within PCD material may at least partly be filled with the catalyst material. The inter-grown diamond structure therefore comprises original diamond grains as well as a newly precipitated or re-grown diamond phase, which bridges the original grains. In the final sintered structure, catalyst/solvent material generally remains present within at least some of the interstices that exist between the sintered diamond grains.

A problem known to exist with such conventional PCD compacts is that they are vulnerable to thermal degradation when exposed to elevated temperatures during cutting and/or wear applications. It is believed that this is due, at least in part, to the presence of residual solvent/catalyst material in the microstructural interstices which, due to the differential that exists between the thermal expansion characteristics of the interstitial solvent metal catalyst material and the thermal expansion characteristics of the intercrystalline bonded diamond, is thought to have a detrimental effect on the performance of the PCD compact at high temperatures. Such differential thermal expansion is known to occur at temperatures of about 400[deg.] C., and is believed to cause ruptures to occur in the diamond-to-diamond bonding, and eventually result in the formation of cracks and chips in the PCD structure. The chipping or cracking in the PCD table may degrade the mechanical properties of the cutting element or lead to failure of the cutting element during drilling or cutting operations thereby rendering the PCD structure unsuitable for further use.

Another form of thermal degradation known to exist with conventional PCD materials is one that is also believed to be related to the presence of the solvent metal catalyst in the interstitial regions and the adherence of the solvent metal catalyst to the diamond crystals. Specifically, at high temperatures, diamond grains may undergo a chemical breakdown or back-conversion with the solvent/catalyst. At extremely high temperatures, the solvent metal catalyst is believed to cause an undesired catalyzed phase transformation in diamond such that portions of diamond grains may transform to carbon monoxide, carbon dioxide, graphite, or combinations thereof, thereby degrading the mechanical properties of the PCD material and limiting practical use of the PCD material to about 750[deg.] C.

Attempts at addressing such unwanted forms of thermal degradation in conventional PCD materials are known in the art. Generally, these attempts have focused on the formation of a PCD body having an improved degree of thermal stability when compared to the conventional PCD materials discussed above. One known technique of producing a PCD body having improved thermal stability involves, after forming the PCD body, removing all or a portion of the solvent catalyst material therefrom using, for example, chemical leaching. Removal of the catalyst/binder from the diamond lattice structure renders the polycrystalline diamond layer more heat resistant.

Due to the hostile environment that cutting elements typically operate, cutting elements having cutting layers with improved abrasion resistance, strength and fracture toughness are desired. However, as PCD material is made more wear resistant, for example by removal of the residual catalyst material from interstices in the diamond matrix, it typically becomes more brittle and prone to fracture and therefore tends to have compromised or reduced resistance to spalling.

There is therefore a need to overcome or substantially ameliorate the above-mentioned problems to provide a PCD material having increased resistance to spalling and chipping.

SUMMARY

Viewed from a first aspect there is provided a polycrystalline super hard construction comprising a body of polycrystalline diamond (PCD) material and a plurality of interstitial regions between inter-bonded diamond grains forming the polycrystalline diamond material; the body of PCD material comprising:

a working surface positioned along an outside portion of the body;

a first region substantially free of a solvent/catalysing material; the first region extending a depth from the working surface into the body of PCD material along a plane substantially perpendicular to the plane along which the working surface extends; and a second region remote from the working surface that includes solvent/catalysing material in a plurality of the interstitial regions;

a substrate attached to the body of PCD material along an interface with the second region;

a chamfer extending between the working surface and a peripheral side surface of the body of PCD material and defining a cutting edge at the intersection of the chamfer and the peripheral side surface; the chamfer having a height, the height being the length along a plane perpendicular to the plane along which the working surface extends between the point of intersection of the chamfer with the working surface and the point of intersection of the chamfer and the peripheral side surface of the body of PCD material; wherein:

the depth of the first region is greater than the height of the chamfer; and wherein a first length along a plane extending from the point of intersection of the chamfer and the peripheral side surface of the PCD body at an angle of between around 65 to 75 degrees to the interface between the first and second regions is between around 60% to around 300% of the depth of the first region.

Viewed from a second aspect there is provided a method for making a thermally stable polycrystalline diamond construction comprising the steps of:

machining a polycrystalline diamond body attached to a substrate along an interface, the polycrystalline diamond body comprising a plurality of interbonded diamond grains and interstitial regions disposed therebetween, to form a chamfer extending between a working surface positioned along an outside portion of the body and a peripheral side surface of the body;

treating the PCD body to remove a solvent/catalyst material from a first region of the diamond body while allowing the solvent/catalyst material to remain in a second region of the diamond body; the first region extending a depth from the working surface into the body of PCD material along a plane substantially perpendicular to the plane along which the working surface extends;

the chamfer defining a cutting edge at the intersection of the chamfer and the peripheral side surface; the chamfer having a height, the height being the length along a plane perpendicular to the plane along which the working surface extends between the point of intersection of the chamfer with the working surface and the point of intersection of the chamfer and the peripheral side surface of the body of PCD material; wherein:

the step of treating further comprises controlling the depth of the first region to be greater than the height of the chamfer; and further controlling the step of treating such that a first length along a plane extending from the point of intersection of the chamfer and the peripheral side surface of the PCD body at an angle of between around 65 to 75 degrees to the interface between the first and second regions is between around 60% to around 300% of the depth of the first region.

In some embodiments, the depth of the first region is between around 400 to around 1400 microns, or between around 500 to around 1400 microns; or between around 600 to around 1400 microns; or between around 800 to around 1400 microns; or between around 850 to around 1400 microns; or between around 800 to around 1200 microns.

BRIEF DESCRIPTION OF THE DRAWINGS

Various embodiments will now be described in more detail, by way of example only, and with reference to the accompanying figures in which.

DETAILED DESCRIPTION OF PREFERRED EMBODIMENTS

Figure 1:
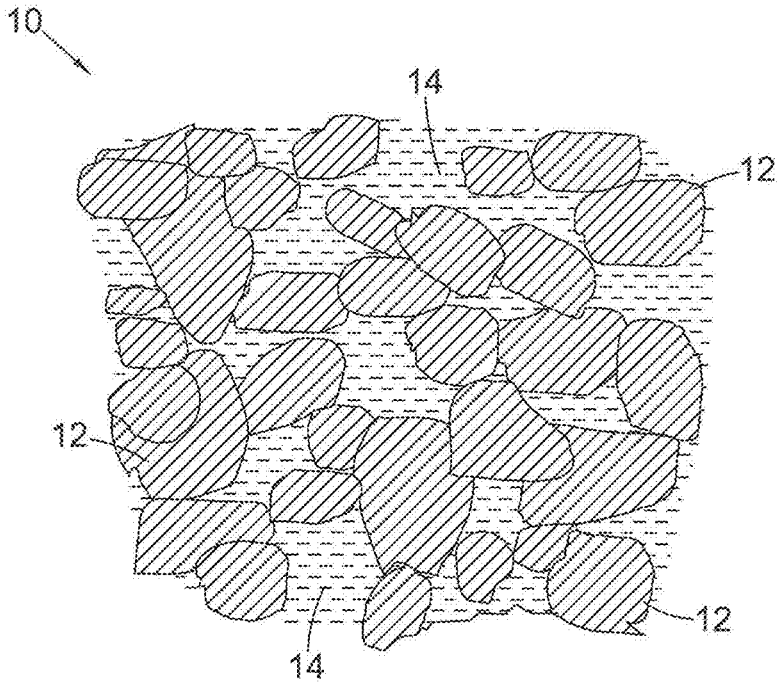
FIG. 1 is a schematic drawing of the microstructure of a body of PCD material.
Figure 2:
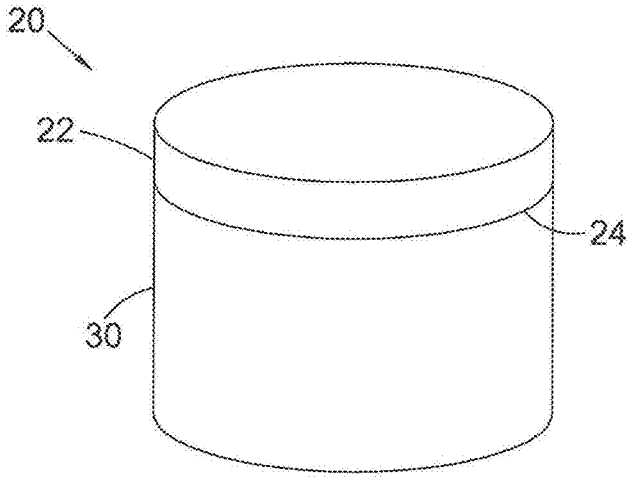
FIG. 2 is a schematic drawing of a PCD compact comprising a PCD structure bonded to a substrate.

With reference to FIG. 1, a body of PCD material 10 comprises a skeletal mass of directly inter-bonded diamond grains 12 and interstices 14 between the diamond grains 12, which may be at least partly filled with filler or binder material. The filler material may comprise, for example, cobalt, nickel or iron and also or in place of may include one or more other non-diamond phase additions such as for example, Titanium, Tungsten, Niobium, Tantalum, Zirconium, Molybdenum, Chromium, or Vanadium, the content of one or more of these within the filler material being, for example about 1 weight % of the filler material in the case of Ti, and, in the case of V, the content of V within the filler material being about 2 weight % of the filler material, and, in the case of W, the content of W within the filler material being about 20 weight % of the filler material.

PCT application publication number WO2008/096314 discloses a method of coating diamond particles, to enable the formation of polycrystalline super hard abrasive elements or composites, including polycrystalline super hard abrasive elements comprising diamond in a matrix selected from materials selected from a group including VN, VC, HfC, NbC, TaC, $Mo_2C$, WC. PCT application publication number WO2011/141898 also discloses PCD and methods of forming PCD containing additions such as vanadium carbide to improve, inter alia, wear resistance.

Whilst wishing not to be bound by any particular theory, the combination of metal additives within the filler material may be considered to have the effect of better dispersing the energy of cracks arising and propagating within the PCD material in use, resulting in altered wear behaviour of the PCD material and enhanced resistance to impact and fracture, and consequently extended working life in some applications.

In accordance with some embodiments, a sintered body of PCD material is created having diamond to diamond bonding and having a second phase comprising catalyst/solvent and WC (tungsten carbide) dispersed through its microstructure together with or instead of a further non-diamond phase carbide such as VC. The body of PCD material may be formed according to standard methods, for example as described in PCT application publication number WO2011/141898, using HpHT conditions to produce a sintered PCD table.

FIGS. 2 and 3*a* to 3*c* show an embodiment of a polycrystalline composite construction 20 for use as a cutter insert for a drill bit (not shown) for boring into the earth. The polycrystalline composite compact or construction 20 comprises a body of super hard material 22 such as PCD material, integrally bonded at an interface 24 to a substrate 30. The substrate 30 may be formed of a hard material such as a cemented carbide material and may be, for example, cemented tungsten carbide, cemented tantalum carbide, cemented titanium carbide, cemented molybdenum carbide or mixtures thereof. The binder metal for such carbides may be, for example, nickel, cobalt, iron or an alloy containing one or more of these metals. Typically, this binder will be present in an amount of 10 to 20 mass %, but this may be as low as 6 mass % or less. Some of the binder metal may infiltrate the body of polycrystalline diamond material 22 during formation of the compact 20.

The super hard material may be, for example, polycrystalline diamond (PCD).

The cutting element 20 may be mounted in use into a bit body such as a drag bit body (not shown). The exposed top surface of the super hard material 22 opposite the substrate 30 forms the working surface 34, which is the surface which, along with its edge 36, performs the cutting in use.

The substrate 30 may be, for example, generally cylindrical and has a peripheral surface and a peripheral top edge.

The exposed surface of the cutter element 20 comprises the working surface 34 which also acts as a rake face in use. A chamfer 44 extends between the working surface 34 and the cutting edge 36, and at least a part of a flank or barrel 42 of the cutter, the cutting edge 36 being defined by the edge of the chamfer 44 and the flank 42.

The working surface or "rake face" 34 of the cutter is the surface or surfaces over which the chips of material being cut flow when the cutter is used to cut material from a body, the rake face 34 directing the flow of newly formed chips. This face 34 is commonly referred to as the top face or working surface of the cutter. As used herein, "chips" are the pieces of a body removed from the work surface of the body by the cutter in use.

As used herein, the "flank" 42 of the cutter is the surface or surfaces of the cutter that passes over the surface produced on the body of material being cut by the cutter and is commonly referred to as the side or barrel of the cutter. The flank 42 may provide a clearance from the body and may comprise more than one flank face.

As used herein, a "cutting edge" 36 is intended to perform cutting of a body in use.

As used herein, a "wear scar" is a surface of a cutter formed in use by the removal of a volume of cutter material due to wear of the cutter. A flank face may comprise a wear scar. As a cutter wears in use, material may be progressively removed from proximate the cutting edge, thereby continually redefining the position and shape of the cutting edge, rake face and flank as the wear scar forms. As used herein, it is understood that the term "cutting edge" refers to the actual cutting edge, defined functionally as above, at any particular stage or at more than one stage of the cutter wear progression up to failure of the cutter, including but not limited to the cutter in a substantially unworn or unused state.

Figure 3A:
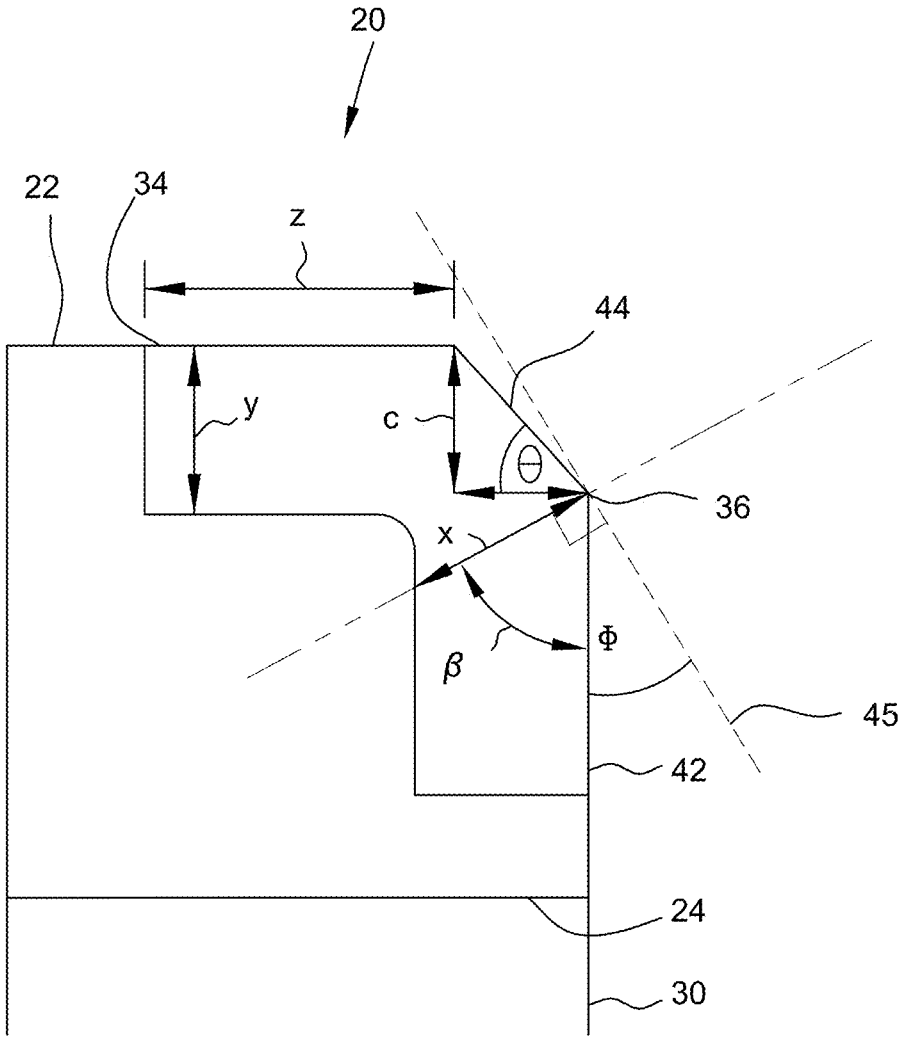
FIGS. 3*a* to 3*c* are schematic cross-sections through a portion of the PCD structure of FIG. 2 according to an embodiment showing progressive wear in application.
Figure 3B:
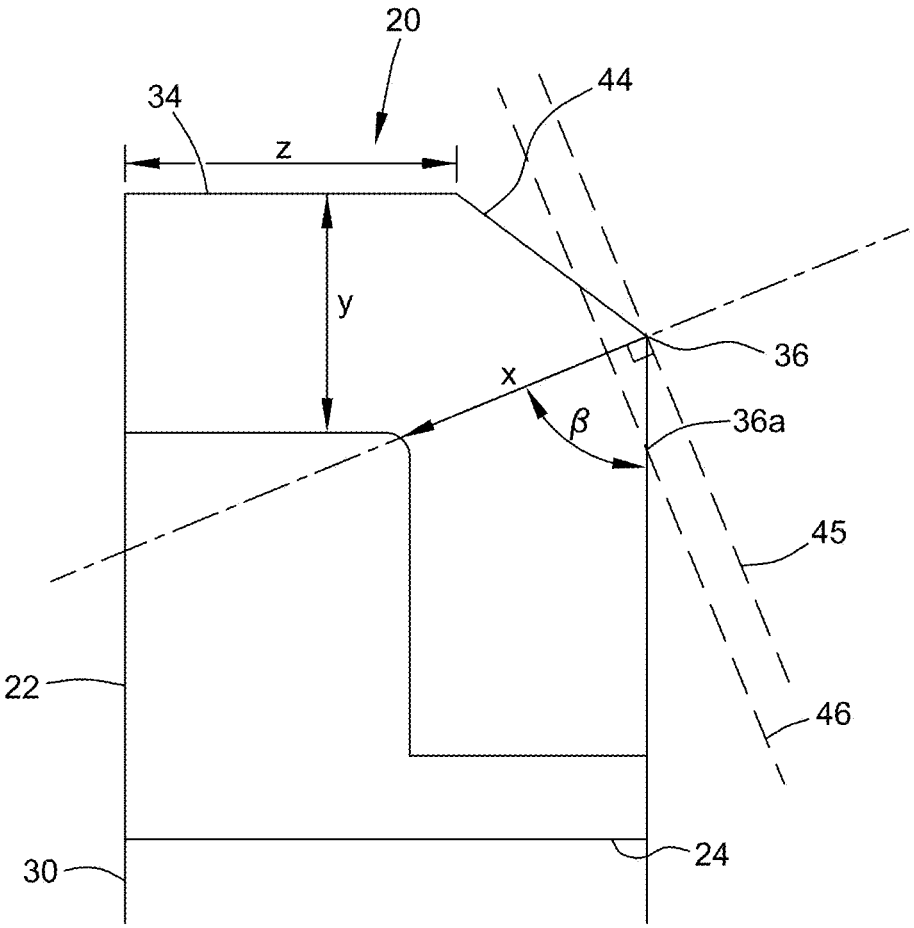
Figure 3C:
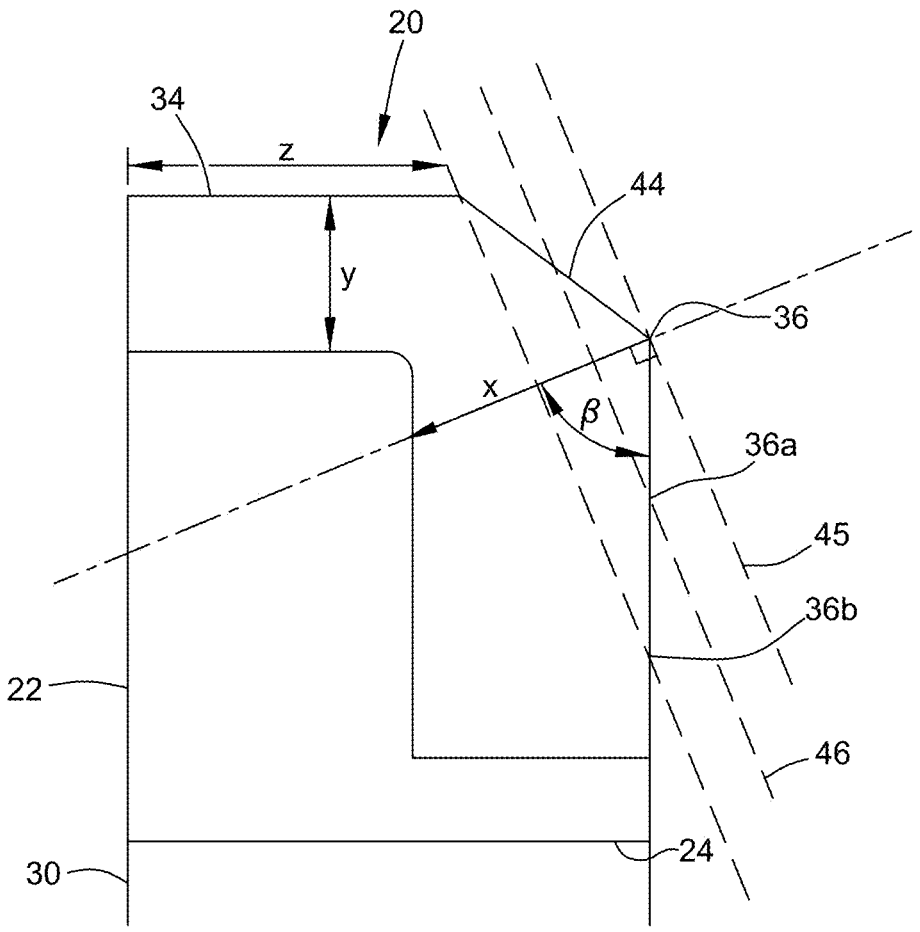

With reference to FIGS. 3*a* to 3*c*, the chamfer 44 is formed in the structure adjacent the cutting edge 36 and flank 42. The rake face 34 is therefore joined to the flank 42 by the chamfer 44 which extends from the cutting edge 36 to the rake face 34, and lies in a plane at a predetermined angle θ to the plane perpendicular to the plane in which the longitudinal axis of the cutter extends. In some embodiments, this chamfer angle is up to around 45 degrees. The vertical height of the chamfer 44 may be, for example, between 350 μm and 450 μm, such as around 400 μm.

FIGS. 3*a* to 3*c*, are schematic representations of the PCD construction 20 which has been treated to remove residual solvent/catalyst from interstitial spaces between the diamond grains using the techniques described in detail below. The depth Y in the PCD layer 22 from the working surface 34 towards the interface 24 with the substrate 30 from which the solvent/catalyst has been substantially removed is known as the leach depth. According to embodiments, this depth Y is at least greater than the vertical height of the chamfer 44. It has been appreciated by the applicant that, surprisingly, this assists in controlling spalling events during use of the PCD construction in applications.

Furthermore, in some embodiments, the length X along the plane which extends at an angle beta (β) between around 65 to 75 degrees from the flank 42, (ie the peripheral side edge of the PCD construction 20 at the point of first contact with the rock in use, namely the cutting edge 36) is between around 60% to around 300% of the length of Y. It has been appreciated by the applicants that this assists in managing the thermal wear events of the construction 20 in use. The combination of this and Y being greater than the vertical height of the chamfer together assists in managing the spalling and thermal wear effects to increase the working life of the PCD construction 20.

In addition, in some embodiments, the leached first region of the PCD body does not extend all the way across the diameter of the working surface 34, but extends only a distance Z across the working surface to the intersection of the edge of the working surface and the top of the chamfer 44. In some embodiments, the distance Z is between around 2 to around 6 mm.

In some embodiments, Y it is at least around 450 microns, or around 500 microns or around 600 microns to around 1200 microns or around 1300 microns or around 1400 microns.

The first point of contact 36 in FIG. 3*a* is the first position of the cutting edge at first use. As the cutter wears, the wear on the cutter is shown by a shift in the dashed line 45 to the position denoted by the second dashed line 46, as shown in FIGS. 3*a* to 3*c*, together with the shift in cutting edge denoted by reference numerals 36*a* and 36*b*. FIG. 3*b* shows the first stage with the first dashed line 45 showing the start of the cut and the second hashed line 46 showing the progressive wear of the super hard material.

FIG. 3*c* shows further wear of the cutter after additional use and shows the progression of the wear scar through the PCD material. The wear has therefore progressed in the leached region only of the PCD.

Whilst not wishing to be bound by theory, it has been appreciated that cracks have a tendency to propagate in the PCD along the interface between leached and unleached regions of the PCD. Ordinarily, once the wear reaches the top of the chamfer 20, this could lead to spalling, however, as the wear scar is maintained in the leached region of PCD at this point, as shown schematically in FIG. 3*c*, spalling is less likely to occur as the interface between the leached and unleached regions of the PCD along which the cracks tend to propagate initiating spalling has yet to be reached by the wear scar.

The cutter of FIGS. 1 to 3*c* may be fabricated, for example, as follows.

As used herein, a "green body" is a body comprising grains to be sintered and a means of holding the grains together, such as a binder, for example an organic binder.

Embodiments of super hard constructions may be made by a method of preparing a green body comprising grains of super hard material and a binder, such as an organic binder. The green body may also comprise catalyst material for promoting the sintering of the super hard grains. The green body may be made by combining the grains with the binder and forming them into a body having substantially the same general shape as that of the intended sintered body, and drying the binder. At least some of the binder material may be removed by, for example, burning it off. The green body may be formed by a method including a compaction process, injection or other methods such as molding, extrusion, deposition modelling methods. The green body may be formed from components comprising the grains and a binder, the components being in the form of sheets, blocks or discs, for example, and the green body may itself be formed from green bodies.

One embodiment of a method for making a green body includes providing tape cast sheets, each sheet comprising, for example, a plurality of diamond grains bonded together by a binder, such as a water-based organic binder, and stacking the sheets on top of one another and on top of a support body. Different sheets comprising diamond grains having different size distributions, diamond content or additives may be selectively stacked to achieve a desired structure. The sheets may be made by a method known in the art, such as extrusion or tape casting methods, wherein slurry comprising diamond grains and a binder material is laid onto a surface and allowed to dry. Other methods for making diamond-bearing sheets may also be used, such as described in U.S. Pat. Nos. 5,766,394 and 6,446,740. Alternative methods for depositing diamond-bearing layers include spraying methods, such as thermal spraying.

A green body for the super hard construction may be placed onto a substrate, such as a cemented carbide substrate to form a pre-sinter assembly, which may be encapsulated in a capsule for an ultra-high pressure furnace, as is known in the art. The substrate may provide a source of catalyst material for promoting the sintering of the super hard grains. In some embodiments, the super hard grains may be diamond grains and the substrate may be cobalt-cemented tungsten carbide, the cobalt in the substrate being a source of catalyst for sintering the diamond grains. The pre-sinter assembly may comprise an additional source of catalyst material.

In one version, the method may include loading the capsule comprising a pre-sinter assembly into a press and subjecting the green body to an ultra-high pressure and a temperature at which the super hard material is thermodynamically stable to sinter the super hard grains. In some embodiments, the green body comprises diamond grains and the pressure to which the assembly is subjected is at least about 5 GPa and the temperature is at least about 1,300 degrees centigrade.

A version of the method may include making a diamond composite structure by means of a method disclosed, for example, in PCT application publication number WO2009/128034 for making a super-hard enhanced hard-metal material. A powder blend comprising diamond particles, and a metal binder material, such as cobalt may be prepared by combining these particles and blending them together. An effective powder preparation technology may be used to blend the powders, such as wet or dry multi-directional mixing, planetary ball milling and high shear mixing with a homogenizer. In one embodiment, the mean size of the diamond particles may be at least about 50 microns and they may be combined with other particles by mixing the powders or, in some cases, stirring the powders together by hand. In one version of the method, precursor materials suitable for subsequent conversion into binder material may be included in the powder blend, and in one version of the method, metal binder material may be introduced in a form suitable for infiltration into a green body. The powder blend may be deposited in a die or mold and compacted to form a green body, for example by uni-axial compaction or other compaction method, such as cold isostatic pressing (CIP). The green body may be subjected to a sintering process known in the art to form a sintered article. In one version, the method may include loading the capsule comprising a pre-sinter assembly into a press and subjecting the green body to an ultra-high pressure and a temperature at which the super hard material is thermodynamically stable to sinter the super hard grains.

After sintering, the polycrystalline super hard constructions may be ground to size and may include, if desired, a 45° chamfer of approximately 0.4 mm height on the body of polycrystalline super hard material so produced.

The sintered article may be subjected to a subsequent treatment at a pressure and temperature at which diamond is thermally stable to convert some or all of the non-diamond carbon back into diamond and produce a diamond composite structure. An ultra-high pressure furnace well known in the art of diamond synthesis may be used and the pressure may be at least about 5.5 GPa and the temperature may be at least about 1,250 degrees centigrade for the second sintering process.

A further embodiment of a super hard construction may be made by a method including providing a PCD structure and a precursor structure for a diamond composite structure, forming each structure into the respective complementary shapes, assembling the PCD structure and the diamond composite structure onto a cemented carbide substrate to form an unjoined assembly, and subjecting the unjoined assembly to a pressure of at least about 5.5 GPa and a temperature of at least about 1,250 degrees centigrade to form a PCD construction. The precursor structure may comprise carbide particles and diamond or non-diamond carbon material, such as graphite, and a binder material comprising a metal, such as cobalt. The precursor structure may be a green body formed by compacting a powder blend comprising particles of diamond or non-diamond carbon and particles of carbide material and compacting the powder blend.

The present disclosure may be further illustrated by the following examples which are not intended to be limiting.

The grains of super hard material, such as diamond grains or particles in the starting mixture prior to sintering may be, for example, bimodal, that is, the feed comprises a mixture of a coarse fraction of diamond grains and a fine fraction of diamond grains. In some embodiments, the coarse fraction may have, for example, an average particle/grain size ranging from about 10 to 60 microns. By "average particle or grain size" it is meant that the individual particles/grains have a range of sizes with the mean particle/grain size representing the "average". The average particle/grain size of the fine fraction is less than the size of the coarse fraction, for example between around 1/10 to 6/10 of the size of the coarse fraction, and may, in some embodiments, range for example between about 0.1 to 20 microns.

In some embodiments, the weight ratio of the coarse diamond fraction to the fine diamond fraction ranges from about 50% to about 97% coarse diamond and the weight ratio of the fine diamond fraction may be from about 3% to about 50%. In other embodiments, the weight ratio of the coarse fraction to the fine fraction will range from about 70:30 to about 90:10.

In further embodiments, the weight ratio of the coarse fraction to the fine fraction may range for example from about 60:40 to about 80:20.

In some embodiments, the particle size distributions of the coarse and fine fractions do not overlap and in some embodiments the different size components of the compact are separated by an order of magnitude between the separate size fractions making up the multimodal distribution.

The embodiments consists of at least a wide bi-modal size distribution between the coarse and fine fractions of super hard material, but some embodiments may include three or even four or more size modes which may, for example, be separated in size by an order of magnitude, for example, a blend of particle sizes whose average particle size is 20 microns, 2 microns, 200 nm and 20 nm.

Sizing of diamond particles/grains into fine fraction, coarse fraction, or other sizes in between, may be through known processes such as jet-milling of larger diamond grains and the like.

In embodiments where the super hard material is polycrystalline diamond material, the diamond grains used to form the polycrystalline diamond material may be natural or synthetic.

In some embodiments, the binder catalyst/solvent may comprise cobalt or some other iron group elements, such as iron or nickel, or an alloy thereof. Carbides, nitrides, borides, and oxides of the metals of Groups IV-VI in the periodic table are other examples of non-diamond material that might be added to the sinter mix. In some embodiments, the binder/catalyst/sintering aid may be Co.

The cemented metal carbide substrate may be conventional in composition and, thus, may be include any of the Group IVB, VB, or VIB metals, which are pressed and sintered in the presence of a binder of cobalt, nickel or iron, or alloys thereof. In some embodiments, the metal carbide is tungsten carbide.

In some embodiments, both the bodies of, for example, diamond and carbide material plus sintering aid/binder/catalyst are applied as powders and sintered simultaneously in a single UHP/HT process. The mixture of diamond grains and mass of carbide are placed in an HP/HT reaction cell assembly and subjected to HP/HT processing. The HP/HT processing conditions selected are sufficient to effect intercrystalline bonding between adjacent grains of abrasive particles and, optionally, the joining of sintered particles to the cemented metal carbide support. In one embodiment, the processing conditions generally involve the imposition for about 3 to 120 minutes of a temperature of at least about 1200 degrees C. and an ultra-high pressure of greater than about 5 GPa.

In another embodiment, the substrate may be pre-sintered in a separate process before being bonded together in the HP/HT press during sintering of the super hard polycrystalline material.

In a further embodiment, both the substrate and a body of polycrystalline super hard material are pre-formed. For example, the bimodal feed of super hard grains/particles with optional carbonate binder-catalyst also in powdered form are mixed together, and the mixture is packed into an appropriately shaped canister and is then subjected to extremely high pressure and temperature in a press. Typically, the pressure is at least 5 GPa and the temperature is at least around 1200 degrees C. The preformed body of polycrystalline super hard material is then placed in the appropriate position on the upper surface of the preform carbide substrate (incorporating a binder catalyst), and the assembly is located in a suitably shaped canister. The assembly is then subjected to high temperature and pressure in a press, the order of temperature and pressure being again, at least around 1200 degrees C. and 5 GPa respectively. During this process the solvent/catalyst migrates from the substrate into the body of super hard material and acts as a binder-catalyst to effect intergrowth in the layer and also serves to bond the layer of polycrystalline super hard material to the substrate. The sintering process also serves to bond the body of super hard polycrystalline material to the substrate.

The practical use of cemented carbide grades with substantially lower cobalt content as substrates for PCD inserts is limited by the fact that some of the Co is required to migrate from the substrate into the PCD layer during the sintering process in order to catalyse the formation of the PCD. For this reason, it is more difficult to make PCD on substrate materials comprising lower Co contents, even though this may be desirable.

An embodiment of a super hard construction may be made by a method including providing a cemented carbide substrate, contacting an aggregated, substantially unbonded mass of diamond particles against a surface of the substrate to form an pre-sinter assembly, encapsulating the pre-sinter assembly in a capsule for an ultra-high pressure furnace and subjecting the pre-sinter assembly to a pressure of at least about 5.5 GPa and a temperature of at least about 1,250 degrees centigrade, and sintering the diamond particles to form a PCD composite compact element comprising a PCD structure integrally formed on and joined to the cemented carbide substrate. In some embodiments of the invention, the pre-sinter assembly may be subjected to a pressure of at least about 6 GPa, at least about 6.5 GPa, at least about 7 GPa or even at least about 7.5 GPa.

The hardness of cemented tungsten carbide substrate may be enhanced by subjecting the substrate to an ultra-high pressure and high temperature, particularly at a pressure and temperature at which diamond is thermodynamically stable. The magnitude of the enhancement of the hardness may depend on the pressure and temperature conditions. In particular, the hardness enhancement may increase the higher the pressure. Whilst not wishing to be bound by a particular theory, this is considered to be related to the Co drift from the substrate into the PCD during press sintering, as the extent of the hardness increase is directly dependent on the decrease of Co content in the substrate.

In embodiments where the cemented carbide substrate does not contain sufficient solvent/catalyst for diamond, and where the PCD structure is integrally formed onto the substrate during sintering at an ultra-high pressure, solvent/catalyst material may be included or introduced into the aggregated mass of diamond grains from a source of the material other than the cemented carbide substrate. The solvent/catalyst material may comprise cobalt that infiltrates from the substrate in to the aggregated mass of diamond grains just prior to and during the sintering step at an ultra-high pressure. However, in embodiments where the content of cobalt or other solvent/catalyst material in the substrate is low, particularly when it is less than about 11 weight percent of the cemented carbide material, then an alternative source may need to be provided in order to ensure good sintering of the aggregated mass to form PCD.

Solvent/catalyst for diamond may be introduced into the aggregated mass of diamond grains by various methods, including blending solvent/catalyst material in powder form with the diamond grains, depositing solvent/catalyst material onto surfaces of the diamond grains, or infiltrating solvent/catalyst material into the aggregated mass from a source of the material other than the substrate, either prior to the sintering step or as part of the sintering step. Methods of depositing solvent/catalyst for diamond, such as cobalt, onto surfaces of diamond grains are well known in the art, and include chemical vapour deposition (CVD), physical vapour deposition (PVD), sputter coating, electrochemical methods, electroless coating methods and atomic layer deposition (ALD). It will be appreciated that the advantages and disadvantages of each depend on the nature of the sintering aid material and coating structure to be deposited, and on characteristics of the grain.

In one embodiment of a method of the invention, cobalt may be deposited onto surfaces of the diamond grains by first depositing a pre-cursor material and then converting the precursor material to a material that comprises elemental metallic cobalt. For example, in the first step cobalt carbonate may be deposited on the diamond grain surfaces using the following reaction:

$$Co(NO_3)_2+Na_2CO_3 \rightarrow CoCO_3+2NaNO_3$$

The deposition of the carbonate or other precursor for cobalt or other solvent/catalyst for diamond may be achieved by means of a method described in PCT patent publication number WO/2006/032982. The cobalt carbonate may then be converted into cobalt and water, for example, by means of pyrolysis reactions such as the following:

$$CoCO_3 \rightarrow CoO+CO_2$$

$$CoO+H_2 \rightarrow Co+H_2O$$

In another embodiment of the method of the invention, cobalt powder or precursor to cobalt, such as cobalt carbonate, may be blended with the diamond grains. Where a precursor to a solvent/catalyst such as cobalt is used, it may be necessary to heat treat the material in order to effect a reaction to produce the solvent/catalyst material in elemental form before sintering the aggregated mass.

In some embodiments, the cemented carbide substrate may be formed of tungsten carbide particles bonded together by the binder material, the binder material comprising an alloy of Co, Ni and Cr. The tungsten carbide particles may form at least 70 weight percent and at most 95 weight percent of the substrate. The binder material may comprise between about 10 to 50 wt. % Ni, between about 0.1 to 10 wt. % Cr, and the remainder weight percent comprises Co. The size distribution of the tungsten carbide particles in the cemented carbide substrate ion some embodiments has the following characteristics:

fewer than 17 percent of the carbide particles have a grain size of equal to or less than about 0.3 microns;

between about 20 to 28 percent of the tungsten carbide particles have a grain size of between about 0.3 to 0.5 microns;

between about 42 to 56 percent of the tungsten carbide particles have a grain size of between about 0.5 to 1 microns;

less than about 12 percent of the tungsten carbide particles are greater than 1 micron; and the mean grain size of the tungsten carbide particles is about 0.6±0.2 microns.

In some embodiments, the binder additionally comprises between about 2 to 20 wt. % tungsten and between about 0.1 to 2 wt. % carbon A layer of the substrate adjacent to the interface with the body of polycrystalline diamond material may have a thickness of, for example, around 100 microns and may comprise tungsten carbide grains, and a binder phase. This layer may be characterised by the following elemental composition measured by means of Energy-Dispersive X-Ray Microanalysis (EDX):

between about 0.5 to 2.0 wt % cobalt;

between about 0.05 to 0.5 wt. % nickel;

between about 0.05 to 0.2 wt. % chromium; and tungsten and carbon.

In a further embodiment, in the layer described above in which the elemental composition includes between about 0.5 to 2.0 wt % cobalt, between about 0.05 to 0.5 wt. % nickel and between about 0.05 to 0.2 wt. % chromium, the remainder is tungsten and carbon.

The layer of substrate may further comprise free carbon.

The magnetic properties of the cemented carbide material may be related to important structural and compositional characteristics. The most common technique for measuring the carbon content in cemented carbides is indirectly, by measuring the concentration of tungsten dissolved in the binder to which it is indirectly proportional: the higher the content of carbon dissolved in the binder the lower the concentration of tungsten dissolved in the binder. The tungsten content within the binder may be determined from a measurement of the magnetic moment, σ, or magnetic saturation, $M_s=4\pi\sigma$, these values having an inverse relationship with the tungsten content (Roebuck (1996), "Magnetic moment (saturation) measurements on cemented carbide materials", *Int. J. Refractory Met.*, Vol. 14, pp. 419-424). The following formula may be used to relate magnetic saturation, Ms, to the concentrations of W and C in the binder:

$$M_s \propto [C]/[W] \times \text{wt. \% Co} \times 201.9 \text{ in units of } \mu T \cdot m^3/kg$$

The binder cobalt content within a cemented carbide material may be measured by various methods well known in the art, including indirect methods such as such as the magnetic properties of the cemented carbide material or more directly by means of energy-dispersive X-ray spectroscopy (EDX), or a method based on chemical leaching of Co.

The mean grain size of carbide grains, such as WC grains, may be determined by examination of micrographs obtained using a scanning electron microscope (SEM) or light microscopy images of metallurgically prepared cross-sections of a cemented carbide material body, applying the mean linear intercept technique, for example. Alternatively, the mean size of the WC grains may be estimated indirectly by measuring the magnetic coercivity of the cemented carbide material, which indicates the mean free path of Co intermediate the grains, from which the WC grain size may be calculated using a simple formula well known in the art. This formula quantifies the inverse relationship between magnetic coercivity of a Co-cemented WC cemented carbide material and the Co mean free path, and consequently the mean WC grain size. Magnetic coercivity has an inverse relationship with MFP.

As used herein, the "mean free path" (MFP) of a composite material such as cemented carbide is a measure of the mean distance between the aggregate carbide grains cemented within the binder material. The mean free path characteristic of a cemented carbide material may be measured using a micrograph of a polished section of the material. For example, the micrograph may have a magnification of about 1000×. The MFP may be determined by measuring the distance between each intersection of a line and a grain boundary on a uniform grid. The matrix line segments, Lm, are summed and the grain line segments, Lg, are summed. The mean matrix segment length using both axes is the "mean free path". Mixtures of multiple distributions of tungsten carbide particle sizes may result in a wide distribution of MFP values for the same matrix content. This is explained in more detail below.

The concentration of W in the Co binder depends on the C content. For example, the W concentration at low C contents is significantly higher. The W concentration and the C content within the Co binder of a Co-cemented WC (WC-Co) material may be determined from the value of the magnetic saturation. The magnetic saturation $4\pi\sigma$ or magnetic moment $\sigma$ of a hard metal, of which cemented tungsten carbide is an example, is defined as the magnetic moment or magnetic saturation per unit weight. The magnetic moment, $\sigma$, of pure Co is 16.1 micro-Tesla times cubic meter per kilogram ($\mu T \cdot m^3/kg$), and the induction of saturation, also referred to as the magnetic saturation, $4\pi\sigma$, of pure Co is 201.9 $\mu T \cdot m^3/kg$.

In some embodiments, the cemented carbide substrate may have a mean magnetic coercivity of at least about 100 Oe and at most about 145 Oe, and a magnetic moment of specific magnetic saturation with respect to that of pure Co of at least about 89 percent to at most about 97 percent.

A desired MFP characteristic in the substrate may be accomplished several ways known in the art. For example, a lower MFP value may be achieved by using a lower metal binder content. A practical lower limit of about 3 weight percent cobalt applies for cemented carbide and conventional liquid phase sintering. In an embodiment where the cemented carbide substrate is subjected to an ultra-high pressure, for example a pressure greater than about 5 GPa and a high temperature (greater than about 1,400° C. for example), lower contents of metal binder, such as cobalt, may be achieved. For example, where the cobalt content is about 3 weight percent and the mean size of the WC grains is about 0.5 micron, the MFP would be about 0.1 micron, and where the mean size of the WC grains is about 2 microns, the MFP would be about 0.35 microns, and where the mean size of the WC grains is about 3 microns, the MFP would be about 0.7 microns. These mean grain sizes correspond to a single powder class obtained by natural comminution processes that generate a log normal distribution of particles. Higher matrix (binder) contents would result in higher MFP values.

Changing grain size by mixing different powder classes and altering the distributions may achieve a whole spectrum of MFP values for the substrate depending on the particulars of powder processing and mixing. The exact values would have to be determined empirically.

In some embodiments, the substrate comprises Co, Ni and Cr.

The binder material for the substrate may include at least about 0.1 weight percent to at most about 5 weight percent one or more of V, Ta, Ti, Mo, Zr, Nb and Hf in solid solution.

In further embodiments, the polycrystalline diamond (PCD) composite compact element may include at least about 0.01 weight percent and at most about 2 weight percent of one or more of Re, Ru, Rh, Pd, Re, Os, Ir and Pt.

Some embodiments of a cemented carbide body may be formed by providing tungsten carbide powder having a mean equivalent circle diameter (ECD) size in the range from about 0.2 microns to about 0.6 microns, the ECD size distribution having the further characteristic that fewer than 45 percent of the carbide particles have a mean size of less than 0.3 microns; 30 to 40 percent of the carbide particles have a mean size of at least 0.3 microns and at most 0.5 microns; 18 to 25 percent of the carbide particles have a mean size of greater than 0.5 microns and at most 1 micron; fewer than 3 percent of the carbide particles have a mean size of greater than 1 micron. The tungsten carbide powder is milled with binder material comprising Co, Ni and Cr or chromium carbides, the equivalent total carbon comprised in the blended powder being, for example, about 6 percent with respect to the tungsten carbide. The blended powder is then compacted to form a green body and the green body is sintered to produce the cemented carbide body.

The sintering the green body may take place at a temperature of, for example, at least 1,400 degrees centigrade and at most 1,440 degrees centigrade for a period of at least 65 minutes and at most 85 minutes.

In some embodiments, the equivalent total carbon (ETC) comprised in the cemented carbide material is about 6.12 percent with respect to the tungsten carbide.

The size distribution of the tungsten carbide powder may, in some embodiments, have the characteristic of a mean ECD of 0.4 microns and a standard deviation of 0.1 microns.

Embodiments are described in more detail below with reference to the following examples which are provided herein by way of illustration only and are not intended to be limiting.

Example 1

A quantity of sub-micron cobalt powder sufficient to obtain 2 mass % in the final diamond mixture was initially de-agglomerated in a methanol slurry in a ball mill with WC milling media for 1 hour. A fine fraction of diamond powder with an average grain size of 2 microns was then added to the slurry in an amount to obtain 10 mass % in the final mixture.

Additional milling media was introduced and further methanol was added to obtain suitable slurry; and this was milled for a further hour. A coarse fraction of diamond, with an average grain size of approximately 20 microns was then added in an amount to obtain 88 mass % in the final mixture. The slurry was again supplemented with further methanol and milling media, and then milled for a further 2 hours. The slurry was removed from the ball mill and dried to obtain the diamond powder mixture.

The diamond powder mixture was then placed into a suitable HpHT vessel, adjacent to a tungsten carbide substrate and sintered at a pressure of around 6.8 GPa and a temperature of about 1500 deg. C.

Example 2

A quantity of sub-micron cobalt powder sufficient to obtain 2.4 mass % in the final diamond mixture was initially de-agglomerated in a methanol slurry in a ball mill with WC milling media for 1 hour. A fine fraction of diamond powder with an average grain size of 2 microns was then added to the slurry in an amount to obtain 29.3 mass % in the final mixture. Additional milling media was introduced and further methanol was added to obtain a suitable slurry; and this was milled for a further hour. A coarse fraction of diamond, with an average grain size of approximately 20 microns was then added in an amount to obtain 68.3 mass % in the final mixture. The slurry was again supplemented with further methanol and milling media, and then milled for a further 2 hours. The slurry was removed from the ball mill and dried to obtain the diamond powder mixture.

The diamond powder mixture was then placed into a suitable HpHT vessel, adjacent to a tungsten carbide substrate and sintered at a pressure of around 6.8 GPa and a temperature of about 1500 deg. C.

The diamond content of the sintered diamond structure is greater than 90 vol % and the coarsest fraction of the distribution is greater than 60 weight % and preferably greater than weight 70%.

In polycrystalline diamond material, individual diamond particles/grains are, to a large extent, bonded to adjacent particles/grains through diamond bridges or necks. The individual diamond particles/grains retain their identity, or generally have different orientations. The average grain/particle size of these individual diamond grains/particles may be determined using image analysis techniques. Images are collected on a scanning electron microscope and are analysed using standard image analysis techniques. From these images, it is possible to extract a representative diamond particle/grain size distribution.

Generally, the body of polycrystalline diamond material will be produced and bonded to the cemented carbide substrate in a HPHT process. In so doing, it is advantageous for the binder phase and diamond particles to be arranged such that the binder phase is distributed homogeneously and is of a fine scale.

The homogeneity or uniformity of the sintered structure is defined by conducting a statistical evaluation of a large number of collected images. The distribution of the binder phase, which is easily distinguishable from that of the diamond phase using electron microscopy, can then be measured in a method similar to that disclosed in EP 0974566. This method allows a statistical evaluation of the average thicknesses of the binder phase along several arbitrarily drawn lines through the microstructure. This binder thickness measurement is also referred to as the "mean free path" by those skilled in the art. For two materials of similar overall composition or binder content and average diamond grain size, the material which has the smaller average thickness will tend to be more homogenous, as this implies a "finer scale" distribution of the binder in the diamond phase. In addition, the smaller the standard deviation of this measurement, the more homogenous is the structure. A large standard deviation implies that the binder thickness varies widely over the microstructure, i.e. that the structure is not even, but contains widely dissimilar structure types.

The binder and diamond mean free path measurements were obtained for various samples formed according to embodiments in the manner set out below. Unless otherwise stated herein, dimensions of mean free path within the body of PCD material refer to the dimensions as measured on a surface of, or a section through, a body comprising PCD material and no stereographic correction has been applied. For example, the measurements are made by means of image analysis carried out on a polished surface, and a Saltykov correction has not been applied in the data stated herein.

In measuring the mean value of a quantity or other statistical parameter measured by means of image analysis, several images of different parts of a surface or section (hereinafter referred to as samples) are used to enhance the reliability and accuracy of the statistics. The number of images used to measure a given quantity or parameter may be, for example between 10 to 30. If the analysed sample is uniform, which is the case for PCD, depending on magnification, 10 to 20 images may be considered to represent that sample sufficiently well.

The resolution of the images needs to be sufficiently high for the inter-grain and inter-phase boundaries to be clearly made out and, for the measurements stated herein an image area of 1280 by 960 pixels was used. Images used for the image analysis were obtained by means of scanning electron micrographs (SEM) taken using a backscattered electron signal. The back-scatter mode was chosen so as to provide high contrast based on different atomic numbers and to reduce sensitivity to surface damage (as compared with the secondary electron imaging mode).

1. A sample piece of the PCD sintered body is cut using wire EDM and polished. At least 10 back scatter electron images of the surface of the sample are taken using a Scanning Electron Microscope at 1000 times magnifications.
2. The original image was converted to a greyscale image. The image contrast level was set by ensuring the diamond peak intensity in the grey scale histogram image occurred between 10 and 20.
3. An auto threshold feature was used to binarise the image and specifically to obtain clear resolution of the diamond and binder phases.
4. The software, having the trade name analySIS Pro from Soft Imaging System® GmbH (a trademark of Olympus Soft Imaging Solutions GmbH) was used and excluded from the analysis any particles which touched the boundaries of the image. This required appropriate choice of the image magnification:

a. If too low then resolution of fine particles is reduced.
b. If too high then:
i. Efficiency of coarse grain separation is reduced.
ii. High numbers of coarse grains are cut by the boarders of the image and hence less of these grains are analysed.
iii. Thus more images must be analysed to get a statistically-meaningful result.

5. Each particle was finally represented by the number of continuous pixels of which it is formed.
6. The AnalySIS software programme proceeded to detect and analyse each particle in the image. This was automatically repeated for several images.
7. Ten SEM images were analyzed using the grey-scale to identify the binder pools as distinct from the other phases within the sample. The threshold value for the SEM was then determined by selecting a maximum value for binder pools content which only identifies binder pools and excludes all other phases (whether grey or white). Once this threshold value is identified it is used to binarize the SEM image.)
8. One pixel thick lines were superimposed across the width of the binarized image, with each line being five pixels apart (to ensure the measurement is sufficiently representative in statistical terms). Binder phase that are cut by image boundaries were excluded in these measurements.
9. The distance between the binder pools along the superimposed lines were measured and recorded—at least 10,000 measurements were made per material being analysed. Median values were reported for both the non-diamond phase mean free paths and diamond phase mean free paths.

Also recorded were the mean free path measurements at Q1 and Q3 for both the diamond and non-diamond phases.

Q1 is typically referred to as the first quartile (also called the lower quartile) and is the number below which lies the 25 percent of the bottom data. Q3 is typically referred to as the third quartile (also called the upper quartile) has 75 percent of the data below it and the top 25 percent of the data above it.

From this, it was determined that embodiments have:
alpha is >=0.50 and <1.5, and beta <0.60,
where
alpha is the non-diamond phase MFP median/(Q3−Q1), which gives a measure of "uniform binder pool size"; and beta=diamond MFP median/(Q3−Q1) which gives a measure of "wide grain size distribution"

In some embodiments, it was determined that alpha >=0.60 and <1.5, or alpha >=0.80 and <1.5, or alpha >=0.83 and <1.5.

In some embodiments, beta <0.60, or <0.50, or <0.47, or <0.4.

Figure 4:
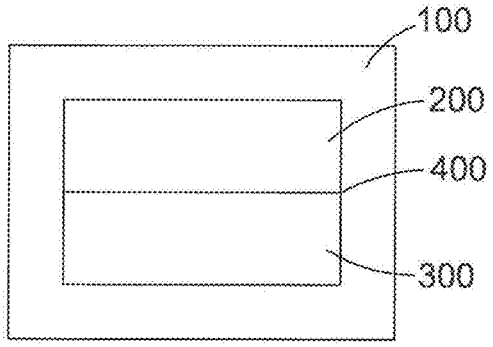
FIG. 4 is a schematic side view of an example assembly comprising first and second structures.

Additional methods for producing the PCD compact 20 comprising the body of PCD material 22, as shown in FIGS. 1 to 3*c*, are illustrated with reference to FIGS. 4 to 10. As shown in FIG. 4, a PCD structure (the second structure) 200 is disposed adjacent a cemented carbide substrate (the first structure) 300, a thin layer or film 400 of binder material comprising Co connecting opposite major surfaces of the PCD structure 200 and the substrate 300 to comprise an assembly encased in a housing 100 for an ultra-high pressure, high temperature press (not shown). The CTE of the PCD material comprised in the PCD structure 200 is in the range from about 2.5×10-6 per degree Celsius to about 4×10-6 per degree Celsius and the CTE of the cobalt-cemented tungsten carbide material comprised in the substrate 300 is in the range from about 5.4×10-6 per degree Celsius to about 6×10-6 per degree Celsius (the CTE values are for 25 degrees Celsius). In this example, the substrate 300 and the PCD structure 200 contain binder material comprising Co. It is estimated that PCD material would have a Young's modulus from about 900 gigapascals to about 1,400 gigapascals depending on the grade of PCD and that the substrate would have a Young's modulus from about 500 gigapascals to about 650 gigapascals depending largely on the content and composition of the binder material.

Figure 5:
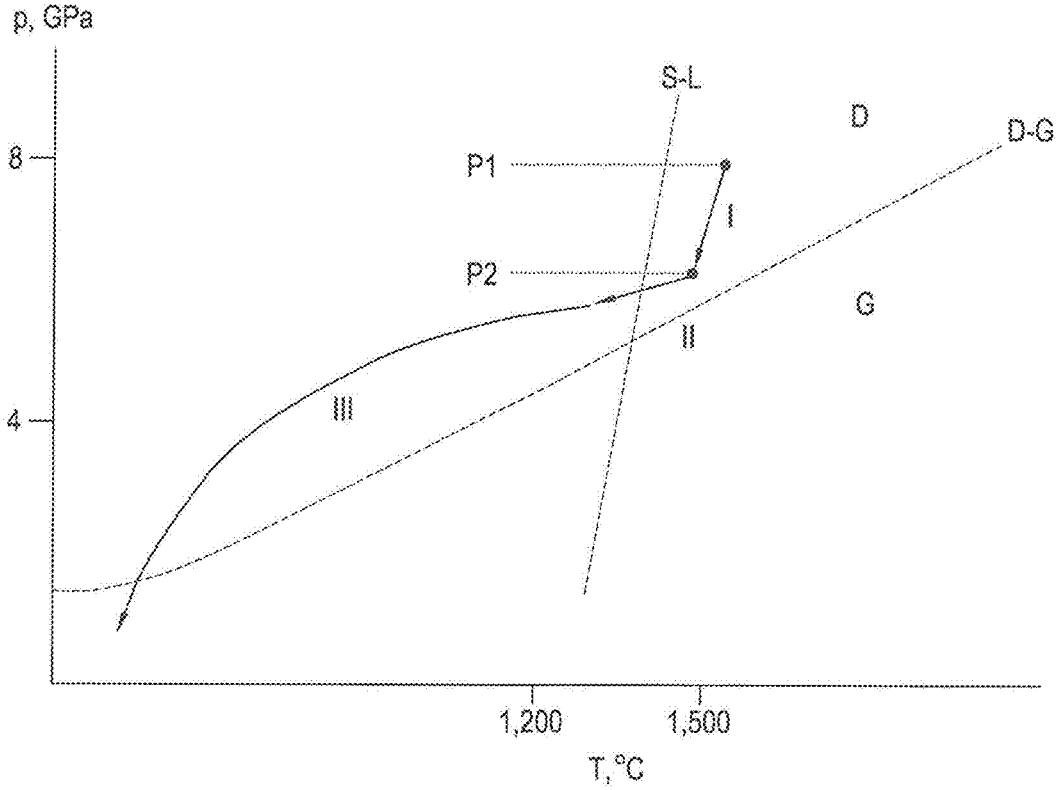
FIG. 5 is a schematic diagram of part of an example pressure and temperature cycle for making a super-hard construction.

FIG. 5 shows a schematic phase diagram of carbon in terms of pressure p and temperature T axes, showing the line D-G of thermodynamic equilibrium between diamond and graphite allotropes, diamond being the more thermally stable in region D and graphite being the more thermally stable in region G of the diagram. The line S-L shows schematically the temperature at which the binder material melts or solidifies at various pressures, this temperature tending to increase with increasing pressure. Note that this temperature is likely to be different from that for the binder material in a pure form because the presence of carbon from the diamond and or some dissolved WC is expected to reduce this temperature, since the presence of carbon in solution is expected to reduce the melting point of cobalt and other metals. The assembly described with reference to FIG. 4 may be under a first pressure P1 of about 7.5 gigapascals to about 8 gigapascal and at a temperature of about 1,450 degrees Celsius to about 1,800 degrees Celsius, at a condition at which the PCD material has been formed by sintering an aggregation of diamond grains disposed adjacent the substrate. There may be no substantial interruption between the formation of the PCD in situ at the sinter pressure and sinter temperature on the one hand and subjecting the assembly to the first pressure P1 on the other; it is the subsequent relationship between the reduction of the pressure and the temperature at stages I and II that is the more relevant aspect of the method. At the sinter temperature, the Co binder material will be molten and expected to promote the direct inter-growth sintering of the diamond grains to form the PCD material, the diamond comprised in the PCD material being thermodynamically substantially more stable than graphite at the sinter temperature and sinter pressure.

With further reference to FIG. 5, the pressure and temperature of the assembly may be reduced to ambient levels in stages I, II and III. In a particular example, the pressure may be reduced in stage I from the first pressure P1 to a second pressure P2 of about 5.5 gigapascals to about 6 gigapascals while reducing the temperature to about 1,350 degrees Celsius to about 1,500 degrees Celsius to ensure that the pressure-temperature condition remains such that diamond is more thermodynamically stable than graphite and that the binder material remains substantially molten. In stage II, the temperature may then be reduced to about 1,100 degrees Celsius to a temperature in the range of about 1,200 degrees Celsius while maintaining the pressure above the line D-G in the diamond-stable region D to solidify the binder material; and in stage III the pressure and temperature may be reduced to ambient levels in various ways. The PCD construction can then be removed from the press apparatus. Note that the stages I, II and III are used merely to explain FIG. 6 and there may not be clear distinction between these stages in practice. For example these stages may flow smoothly into one another with no substantial period of maintaining pressure and temperature conditions at the end of a stage. Alternatively, some or all of the stages may be distinct and the pressure and temperature condition at the end of a stage may be maintained for a period.

In some examples, a pre-sinter assembly for making a PCD construction, for example, may be prepared and provided in situ at the first pressure P1 as follows. A cup may be provided into which an aggregation comprising a plurality of diamond grains and a substrate may be assembled, the interior shape of the cup being generally that of the desired shape of the PCD structure (having regard to likely distortion during the sintering step). The aggregation may comprise substantially loose diamond grains or diamond-containing pre-cursor structures such as granules, discs, wafers or sheets. The aggregation may also include catalyst material for diamond, or pre-cursor material for catalyst material, which may be admixed with the diamond grains and or deposited on the surfaces of the diamond grains. The diamond grains may have a mean size of at least about 0.1 micron and or at most about 75 microns and may be substantially mono-modal or multi-modal. The aggregation may also contain additives for reducing abnormal diamond or grain growth or the aggregation may be substantially free of catalyst material or additives. Alternatively or additionally, another source of catalyst or matrix material such as cobalt may be provided, such as the binder material in a cemented carbide substrate. A sufficient quantity of the aggregation may be placed into the cup and then the substrate may inserted into the cup with a proximate end pushed against the aggregation. The pre-sinter assembly comprising the aggregation and the substrate may be encased within a metal jacket comprising the cup, subjected to a heat treatment to burn off organic binder that may be comprised in the aggregation, and encapsulated within a housing (which may be referred to as a capsule) suitable for an ultra-high pressure press. The housing may be placed in a suitable ultra-high pressure press apparatus and subjected to a sinter pressure and sinter temperature to form the assembly comprising a PCD structure adjacent the substrate, connected by a thin film of molten binder comprising cobalt. In examples such as these, the sinter pressure may be regarded as the first pressure P1.

In an example arrangement, a pre-sinter assembly for making a PCD construction may be prepared and provided in a press apparatus at the first pressure P1 as follows. A PCD structure may be provided pre-sintered in a previous ultra-high pressure, high temperature process. The PCD structure may contain binder material comprising cobalt, located in interstitial regions between the diamond grains comprised in the PCD material. In the case of PCD material, the PCD structure may have at least a region substantially free of binder material. For example, the PCD structure may have been treated in acid to remove binder material from the interstices at least adjacent a surface of the PCD structure or throughout substantially the entire volume of the PCD structure (or variations between these possibilities), leaving at least a region that may contain pores or voids. In some examples, voids thus created may be filled with a filler material that may or may not comprise binder material. The PCD structure may be placed against a substrate and the resulting pre-construction assembly may be encased within a housing suitable for an ultra-high pressure press. The housing may be placed in a suitable ultra-high pressure press apparatus and the subjected to the first pressure P1 at a temperature at which the binder material is in the liquid state (at a condition in region D of FIG. 5).

Example methods for making an example PCD construction will be described below with reference to FIGS. 6 to 10. In each figure, only part of the pressure and temperature cycle is shown, the part beginning at respective first pressures P1, at which the PCD material comprised in the construction becomes formed by sintering, and ending after the temperature has been reduced sufficiently to solidify the binder material and the pressure has been reduced from the second pressure P2.

In some examples, a pre-sinter assembly may be provided, comprising an aggregation of a plurality of diamond grains located adjacent a surface of a substrate comprising cobalt-cemented tungsten carbide. The diamond grains may have a mean size in the range of about 0.1 to about 40 microns. The pre-sinter assembly may be encapsulated within a capsule for an ultra-high pressure press apparatus, into which the capsule may be loaded. The capsule may be pressurised at ambient temperature to a pressure of at least about 6.5 gigapascals and heated to a temperature in the range of about 1,500 to about 1,600 degrees Celsius, substantially greater than the melting point (at the pressure) of the cobalt-based binder material comprised in the substrate and causing the cobalt material to melt. At this temperature the pre-sinter assembly may be at a first pressure P1 in the range from about 7.5 to about 10 gigapascals (P1 may be somewhat higher than 7 gigapascals at least partly as a result of the increase in temperature). The first pressure P1 and the temperature may be substantially maintained for at least about 1 minute, or in any event sufficiently long to sinter together the diamond grains (in these examples, the sinter pressure will be substantially P1). The pressure may then be reduced from first pressure P1 through a second pressure P2 in the range from about 5.5 to about 8.5 gigapascals. The second pressure may be the pressure at which the binder material begins to solidify as the temperature is reduced through its solidification temperature.

The temperature of the pre-sinter assembly may be reduced simultaneously with pressure, provided that it remains greater than the temperature at which the cobalt-based binder material will have completely solidified. As the pressure is reduced from P2, the temperature may also be reduced through the solidification line of the cobalt-based binder material, resulting in the solidification of the binder material. In these particular examples, the pressure is substantially continuously reduced from the first pressure P1, through the second pressure P2 and through the pressure(s) at which the binder material solidifies, without substantial pause. The rate of reduction of the pressure and or temperature may be varied or the rate of the reduction of either or both may be substantially constant, at least until the cobalt-based binder material has solidified. The temperature may also be reduced substantially continuously at least until it is sufficiently low for substantially all the cobalt-based binder material to have solidified. The temperature and pressure may then be reduced to ambient conditions, the capsule removed from the ultra-high pressure press apparatus and the construction removed from the capsule. The construction may comprise a sintered PCD structure formed joined to the substrate, the PCD structure having become joined to the substrate in the same general step in which the PCD material was formed by the sintering together of the plurality of diamond grains. A thin layer rich in cobalt will be present between the PCD structure and the substrate, joining together these structures.

Figure 6:
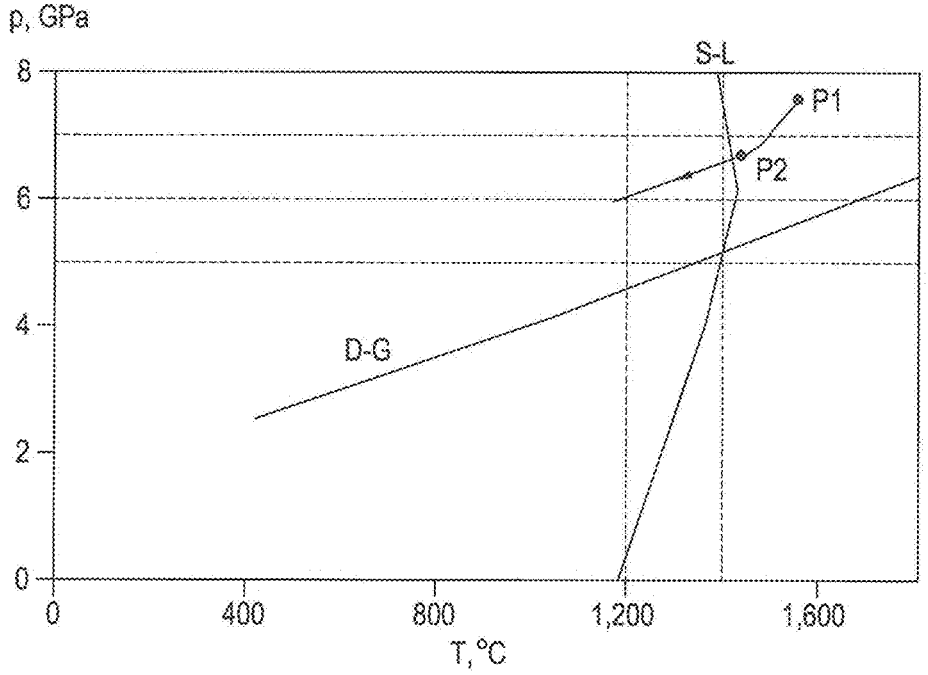
FIGS. 6 to 10 are schematic diagrams of parts of example pressure and temperature cycles for making a PCD construction.

In a particular example method illustrated in FIG. 6, the first pressure P1 is about 7.6 gigapascals, the temperature at the first pressure being in the range of about 1,500 to about 1,600 degrees Celsius, and an example second pressure P2 is about 6.8 gigapascals.

Figure 7:
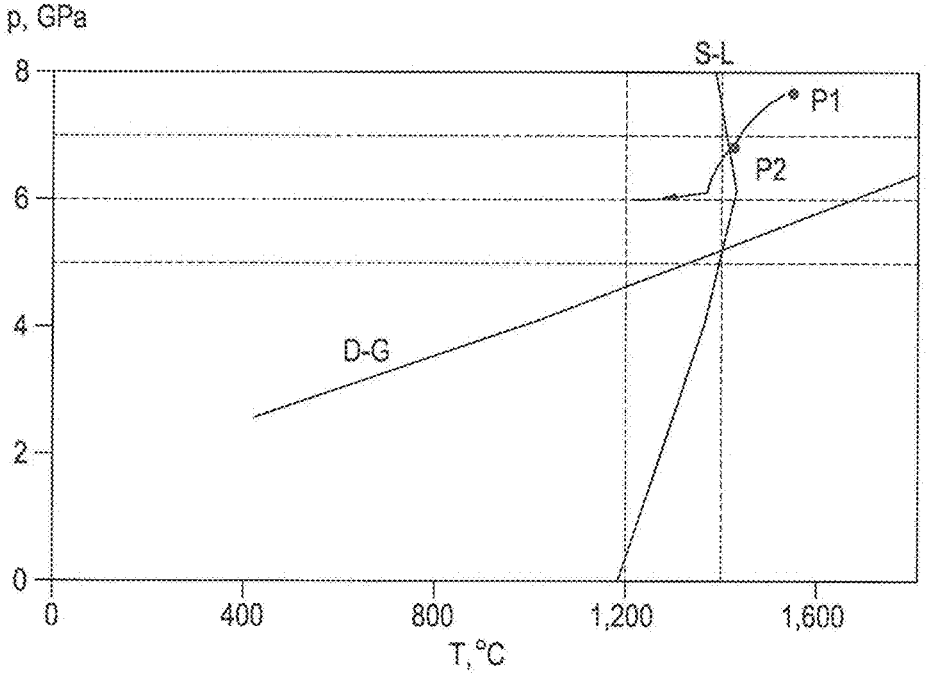

In a particular example method illustrated in FIG. 7, the first pressure P1 is about 7.7 gigapascals, the temperature at the first pressure being in the range of about 1,500 to about 1,600 degrees Celsius, and an example second pressure P2 is about 6.9 gigapascals.

Figure 8:
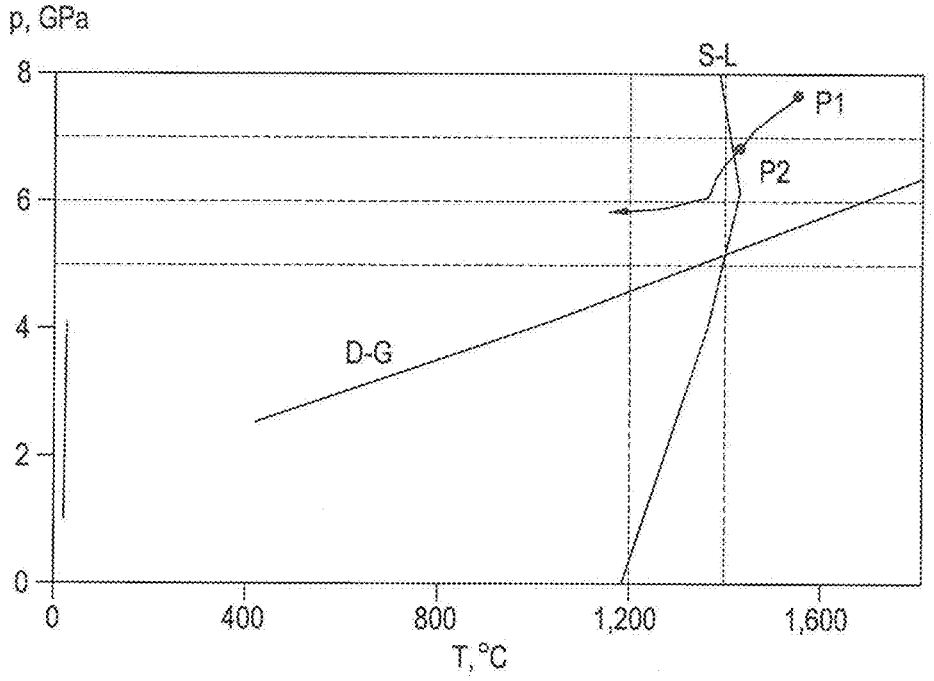

In a particular example method illustrated in FIG. 8, the first pressure P1 is about 7.8 gigapascals, the temperature at the first pressure being in the range of about 1,500 to about 1,600 degrees Celsius, and an example second pressure P2 is about 6.9 gigapascals.

Figure 9:
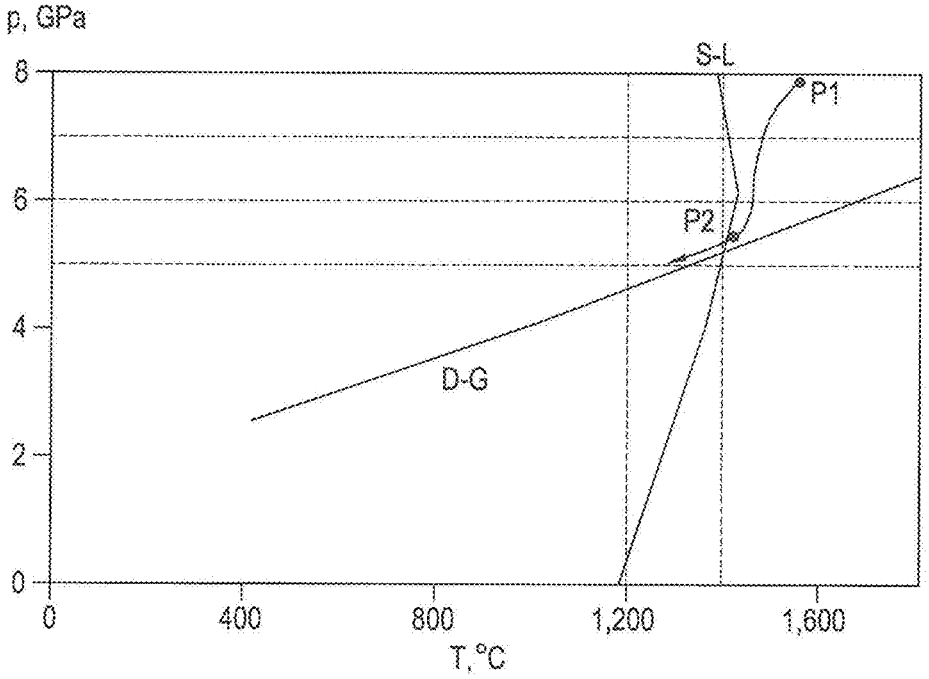

In a particular example method illustrated in FIG. 9, the first pressure P1 is about 7.9 gigapascals, the temperature at the first pressure being in the range of about 1,500 to about 1,600 degrees Celsius, and an example second pressure P2 is about 5.5 gigapascals.

Figure 10:
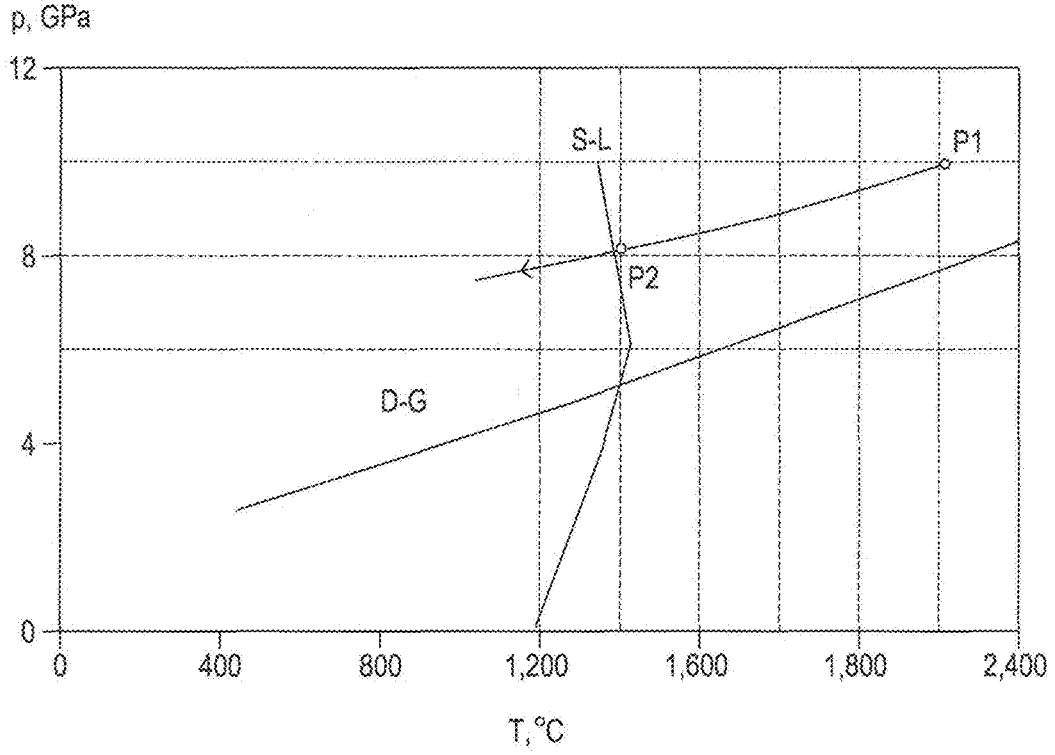

In the example method illustrated in FIG. 10, the first pressure P1 is about 9.9 gigapascals, the temperature at the first pressure being about 2,000 degrees Celsius, and an example second pressure P2 may be about 8.1 gigapascals.

Note that the line S-L in FIGS. 6 to 10, indicating the melting and solidification temperatures of cobalt-based binder material in the presence of carbon, was estimated based on a calculation using available data. In practice, it may be advisable not to rely completely on calculated values lying on S-L but to carry out trial and error experiments to discover the melting and solidification temperatures for the particular binder material and pressure being used.

The method used to measure the pressure and temperature cycles as illustrated in FIGS. 6 to 10 is measured using so-called K-type thermocouples and knowledge of the melting temperatures of copper (Cu) and silver (Ag). Data for the melting points of Cu and Ag measured using K-type thermocouples up at 60 kilobars was published by P. W. Mirwald and G. C. Kennedy in an article entitled "The melting curve of gold, silver and copper to 60-Kbar pressure—a reinvestigation", published on 10 Nov. 1979 in the Journal of Geophysical Research volume 84, number B12, pages 6750 to 6756, by The American Geophysical Union. A K-type thermocouple may also be referred to as a "chromel-alumel" thermocouple, in which the "chromel" component comprises 90 percent nickel and 10 percent chromium, and the "alumel" component comprises 95 percent nickel, 2 percent manganese, 2 percent aluminium and 1 percent silicon. The method includes inserting the junction of a first K-type thermocouple into a body consisting essentially of Cu and the junction of a second K-type thermocouple into a body consisting essentially of Ag, and positioning the two bodies proximate the pre-sinter assembly within the capsule. The readings from both thermocouples are recorded throughout at least a part of the pressure and temperature cycle and the readings processed and converted to pressure and temperature values according to the published data.

Various kinds of ultra-high pressure presses may be used, including belt-type, tetrahedral multi-anvil, cubic multi-anvil, walker-type or torroidal presses. The choice of press type is likely to depend on the volume of the super-hard construction to be made and the pressure and temperature desired for sintering the super-hard material. For example, tetrahedral and cubic presses may be suitable for sintering commercially viable volumes of PCD material at pressures of at least about 7 gigapascals or at least about 7.7 gigapascals.

Some example methods may include subjecting a PCD construction to a heat treatment at a temperature of at least about 500 degrees Celsius, at least about 600 degrees Celsius or at least about 650 degrees Celsius for at least about 5 minutes, at least about 15 minutes or at least about 30 minutes. In some embodiments, the temperature may be at most about 850 degrees Celsius, at most about 800 degrees Celsius or at most about 750 degrees Celsius. In some embodiments, the PCD structure may be subjected to the heat treatment for at most about 120 minutes or at most about 60 minutes. In one embodiment, the PCD structure may be subjected to the heat treatment in a vacuum. For example, U.S. Pat. No. 6,517,902 discloses a form of heat treatment for pre-form elements having a facing table of PCD bonded to a substrate of cemented tungsten carbide with a cobalt binder. The substrate includes an interface zone with at least 30 percent by volume of the cobalt binder in a hexagonal close packed crystal structure.

While wishing not to be bound by a particular theory, the method may result in a reduced likelihood or frequency of cracking of super-hard constructions because the residual stress within the construction is reduced.

Further non-limiting examples are described in more detail below.

Example 3

A PCD insert for a rock-boring drill bit was made as described below.

A pre-sinter assembly was prepared, comprising an aggregation of a plurality of diamond grains disposed against a proximate end of a generally cylindrical cemented carbide substrate. The aggregation comprised a plurality of wafers comprising diamond grains dispersed within an organic binder material, the diamond grains having a mean size of at least about 15 microns and at most about 30 microns. The substrate comprised about 90 weight percent WC grains cemented together by a binder material comprising Co. The pre-sinter assembly was enclosed in a metal jacket and heated to burn off the organic binder comprised in the wafers, and the jacketed, pre-sinter assembly was encapsulated in a capsule for an ultra-high pressure, high temperature multi-anvil press apparatus.

The pre-sinter assembly was subjected to a pressure of about 7.7 gigapascals and a temperature of about 1,550 degrees Celsius to sinter the diamond grains directly to each other to form a layer of PCD material connected to the proximate end of the substrate by a film of molten binder material comprising cobalt from the substrate. The pressure was reduced to about 5.5 gigapascals and the temperature was reduced to about 1,450 degrees Celsius, maintaining conditions at which the diamond comprised in the PCD is thermodynamically stable (in relation to graphite, a softer allotrope of carbon) and at which the binder material is in the liquid phase. The temperature was then reduced to about 1,000 degrees Celsius to solidify the binder material and form a construction comprising the layer of PCD bonded to the substrate by the solidified binder material, and the pressure and temperature were then reduced to ambient conditions.

The construction was subjected to a heat treatment at 660 degrees Celsius for about 2 hours at substantially ambient pressure in a substantially non-oxidising atmosphere, and then cooled to ambient temperature. No cracks were evident in the PCD layer after the heat treatment.

The construction was processed by grinding and polishing to provide an insert for a rock-boring drill bit.

For comparison, a reference construction was made as follows. A pre-sinter assembly was prepared as described above in relation to the example pre-sinter assembly. The pre-sinter assembly was subjected to a pressure of about 7.7 gigapascal and a temperature of about 1,550 degrees Celsius to sinter the diamond grains directly to each other to form a layer of PCD material connected to the proximate end of the substrate by a film of molten binder material comprising cobalt from the substrate. The temperature was reduced to about 1,000 degrees Celsius to solidify the binder material and form a construction comprising the layer of PCD bonded to the substrate by the solidified binder material, and then the pressure and temperature were reduced to ambient conditions. The construction was subjected to a heat treatment at 660 degrees Celsius for about 2 hours at substantially ambient pressure in a substantially non-oxidising atmosphere, and then cooled to ambient temperature. Severe cracks were evident at the side of the PCD layer after the heat treatment.

Example 4

A PCD insert for a rock-boring drill bit was made as described below.

A pre-sinter assembly was prepared, comprising a PCD structure having a generally disc-like shape disposed against a proximate end of a generally cylindrical cemented carbide substrate. PCD structure had been made in a previous step involving sintering together an aggregation of a plurality of diamond grains at an ultra-high pressure of less than about 7 gigapascals and a high temperature (at which the diamond was thermodynamically more stable than graphite). The substrate comprised about 90 weight percent WC grains cemented together by a binder material comprising Co. The pre-sinter assembly was enclosed in a metal jacket and heated to burn off the organic binder comprised in the wafers, and the jacketed, pre-sinter assembly was encapsulated in a capsule for an ultra-high pressure, high temperature multi-anvil press apparatus.

The pre-sinter assembly was subjected to a pressure of about 7.7 gigapascals and a temperature of about 1,550 degrees Celsius to modify the microstructure of the PCD structure. The pressure was reduced to about 5.5 gigapascals and the temperature was reduced to about 1,450 degrees Celsius, maintaining conditions at which the diamond comprised in the PCD is thermodynamically stable (in relation to graphite, a softer allotrope of carbon) and at which the binder material is in the liquid phase. The temperature was then reduced to about 1,000 degrees Celsius to solidify the binder material and form a construction comprising the layer of PCD bonded to the substrate by the solidified binder material, and the pressure and temperature were then reduced to ambient conditions.

The construction was subjected to a heat treatment at 660 degrees Celsius for about 2 hours at substantially ambient pressure in a substantially non-oxidising atmosphere, and then cooled to ambient temperature. No cracks were evident in the PCD layer after the heat treatment.

The construction was processed by grinding and polishing to provide an insert for a rock-boring drill bit.

As used herein, the thickness of the PCD structure 22, 200 or the substrate 30, 300, or some part of the PCD structure or the substrate is the thickness measured substantially perpendicularly to the interface 24. In some embodiments, the PCD structure, or body of PCD material 22, 200 may have a generally wafer, disc or disc-like shape, or be in the general form of a layer. In some embodiments, the PCD structure 22, 200 may have a thickness of at least about 0.3 mm, at least about 0.5 mm, at least about 0.7 mm, at least about 1 mm, at least about 1.3 mm or at least about 2 mm. In one embodiment, the PCD structure 22, 200 may have a thickness in the range from about 2 mm to about 3 mm.

In some embodiments, the substrate 30, 300 may have the general shape of a wafer, disc or post, and may be generally cylindrical in shape. The substrate 30, 300 may have, for example, an axial thickness at least equal to or greater than the axial thickness of the body of PCD material 22, 200, and may be for example at least about 1 mm, at least about 2.5 mm, at least about 3 mm, at least about 5 mm or even at least about 10 mm in thickness. In one embodiment, the substrate 30, 300 may have a thickness of at least 2 cm.

The PCD structure 22, 200 may be joined to the substrate 30, 300 for example only on one side thereof, the opposite side of the PCD structure not being bonded to the substrate 30, 300.

In some embodiments, the largest dimension of the body of PCD material 22, 200 is around 6 mm or greater, for example in embodiments where the body of PCD material is cylindrical in shape, the diameter of the body is around 6 mm or greater.

In some versions of the method, prior to sintering, the aggregated mass of diamond particles/grains may be disposed against the surface of the substrate generally in the form of a layer having a thickness of least about 0.6 mm, at least about 1 mm, at least about 1.5 mm or even at least about 2 mm. The thickness of the mass of diamond grains may reduce significantly when the grains are sintered at an ultra-high pressure.

The super hard particles used in the present process may be of natural or synthetic origin. The mixture of super hard particles may be multimodal, that it is may comprise a mixture of fractions of diamond particles or grains that differ from one another discernibly in their average particle size. Typically the number of fractions may be:

a specific case of two fractions three or more fractions.

By "average particle/grain size" it is meant that the individual particles/grains have a range of sizes with the mean particle/grain size representing the "average". Hence the major amount of the particles/grains will be close to the average size, although there will be a limited number of particles/grains above and below the specified size. The peak in the distribution of the particles will therefore be at the specified size. The size distribution for each super hard particle/grain size fraction is typically itself monomodal, but may in certain circumstances be multimodal. In the sintered compact, the term "average particle grain size" is to be interpreted in a similar manner.

As shown in FIG. 1, the bodies of polycrystalline diamond material produced by an embodiment additionally have a binder phase present. This binder material is preferably a catalyst/solvent for the super hard abrasive particles used. Catalyst/solvents for diamond are well known in the art. In the case of diamond, the binder is preferably cobalt, nickel, iron or an alloy containing one or more of these metals. This binder may be introduced either by infiltration into the mass of abrasive particles during the sintering treatment, or in particulate form as a mixture within the mass of abrasive particles. Infiltration may occur from either a supplied shim or layer of the binder metal or from the carbide support. Typically a combination of the admixing and infiltration approaches is used.

During the high pressure, high temperature treatment, the catalyst/solvent material melts and migrates through the compact layer, acting as a catalyst/solvent and causing the super hard particles to bond to one another. Once manufactured, the PCD construction therefore comprises a coherent matrix of super hard (diamond) particles bonded to one another, thereby forming an super hard polycrystalline composite material with many interstices or pools containing binder material as described above. In essence, the final PCD construction therefore comprises a two-phase composite, where the super hard abrasive diamond material comprises one phase and the binder (non-diamond phase), the other.

In one form, the super hard phase, which is typically diamond, constitutes between 80% and 95% by volume and the solvent/catalyst material the other 5% to 20%.

The relative distribution of the binder phase, and the number of voids or pools filled with this phase, is largely defined by the size and shape of the diamond grains.

The binder (non-diamond) phase can help to improve the impact resistance of the more brittle abrasive phase, but as the binder phase typically represents a far weaker and less abrasion resistant fraction of the structure, and high quantities will tend to adversely affect wear resistance. Additionally, where the binder phase is also an active solvent/catalyst material, its increased presence in the structure can compromise the thermal stability of the compact.

Figure 11A:
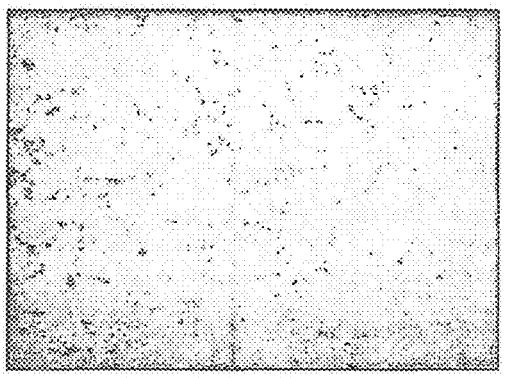
FIGS. 11*a* and 11*b* are processed images of a micrograph (shown in negative) of a polished section of an embodiment of a body of PCD material at different diamond densities.
Figure 11B:
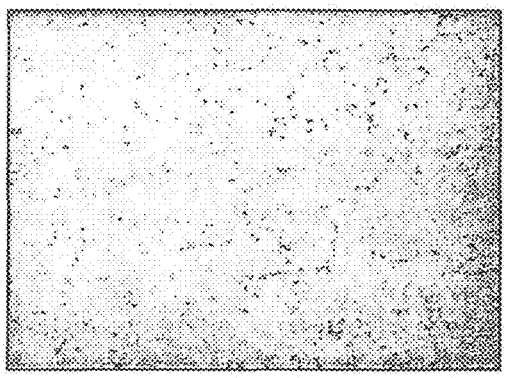

FIGS. 11*a* and 11*b* are an example of a processed SEM image of a polished section of a PCD material, shown in negative, for a diamond intensity of 0 (FIG. 11*a*) and a diamond intensity of 15 (FIG. 11*b*) showing the boundaries between diamond grains. These boundary lines were provided by image analysis software and were used to measure the total non-diamond phase (eg binder) surface area in a cross-section through the body of PCD material and surface area of the individual non-diamond phase (interstitial) regions which are indicated as dark areas in the actual SEM images but are shown in the negative (ie as light areas) in FIGS. 11*a* and 11*b*. The cross-section through the body of PCD material may be at any orientation through the body of PCD material for the following analysis to be conducted and results to be achieved. The image analysis technique is described in more detail below.

As a non-limiting example, the cross section shown in FIGS. 11*a* and 11*b* may be exposed for viewing by cutting a section of the PCD composite compact by means of a wire EDM. The cross section may be polished in preparation for viewing by a microscope, such as a scanning electron microscope (SEM) and a series of micrographic images may be taken. Each of the images may be analysed by means of image analysis software to determine the total binder area and individual binder areas between the diamond grains. The values of the total binder area and individual binder area are determined by conducting a statistical evaluation on a large number of collected images taken on the scanning electron microscope.

The magnification selected for the microstructural analysis has a significant effect on the accuracy of the data obtained. Imaging at lower magnifications offers an opportunity to sample, representatively, larger particles or features in a microstructure but may tend to under-represent smaller particles or features as they are not necessarily sufficiently resolved at that magnification. By contrast, higher magnifications allow resolution and hence detailed measurement of fine-scale features but can tend to sample larger features such that they intersect the boundaries of the images and hence are not adequately measured. It has been appreciated that it is therefore important to select an appropriate magnification for any quantitative microstructural analysis technique. The appropriateness is therefore determined by the size of the features that are being characterised. The magnifications selected for the various measurements described herein are discussed in more detail below.

Unless otherwise stated herein, dimensions of total binder area and individual binder area within the body of PCD material refer to the dimensions as measured on a surface of, or a section through, a body comprising PCD material and no stereographic correction has been applied. For example, the measurements are made by means of image analysis carried out on a polished surface, and a Saltykov correction has not been applied in the data stated herein.

In measuring the mean value of a quantity or other statistical parameter measured by means of image analysis, several images of different parts of a surface or section (hereinafter referred to as samples) are used to enhance the reliability and accuracy of the statistics. The number of images used to measure a given quantity or parameter may be, for example between 10 to 30. If the analysed sample is uniform, which is the case for PCD, depending on magnification, 10 to 20 images may be considered to represent that sample sufficiently well.

The resolution of the images needs to be sufficiently high for the inter-grain and inter-phase boundaries to be clearly made out and, for the measurements stated herein an image area of 1280 by 960 pixels was used.

In the statistical analysis, 15 images were taken of different areas on a surface of a body comprising the PCD material, and statistical analysis was carried out on each image.

Images used for the image analysis were obtained by means of scanning electron micrographs (SEM) taken using a backscattered electron signal. The back-scatter mode was chosen so as to provide high contrast based on different atomic numbers and to reduce sensitivity to surface damage (as compared with the secondary electron imaging mode).

A number of factors have been identified as being important for image capturing. These are:

- SEM Voltage which, for the purposes of the measurements stated herein remained constant and was around 15 kV;
- working distance which also remained constant and was around 8 mm
- image sharpness
- sample polishing quality,
- image contrast levels which were selected to provide clear separation of the microstructural features;
- magnification (should be varied according to different diamond grain size and is as stated below),
- number of images taken.

Given the above conditions, the image analysis software used was able to separate distinguishably the diamond and binder phases and the back-scatter images were taken at approximately 45° to the edge of the samples.

The magnification used in the image analysis should be selected in such a way that the feature of interest is adequately resolved and described by the available number of pixels. In PCD image analysis various features of different size and distribution are measured simultaneously and it is not practical to use a separate magnification for each feature of interest.

It is difficult to identify the optimum magnification for each feature measurement in the absence of a reference measurement result. It could vary from one operator to another. Therefore, a procedure is proposed for the selection of the magnification.

The size of a statistically significant number of diamond grains in the microstructure is measured and the average value taken.

As used herein in relation to grains or particles and unless otherwise stated or implied, the term "size" refers to the length of the grain viewed from the side or in cross section using image analysis techniques.

The number of pixels that describe this average length is determined and a range of pixel values are established to fix the magnification.

In the image analysis technique, the original image was converted to a greyscale image. The image contrast level was set by ensuring the diamond peak intensity in the grey scale histogram image occurred between 15 and 20.

As mentioned above, several images of different parts of a surface or section were taken to enhance the reliability and accuracy of the statistics. For measurements of total non-diamond phase (eg binder) area, the greater the number of images, the more accurate the results are perceived to be. For example, about 15000 measurements were taken, 1000 per image with 15 images.

The steps taken by the image analysis programme may be summarised in general as follows:

1. The original image was converted to a greyscale image. The image contrast level was set by ensuring the diamond peak intensity in the grey scale histogram image occurred between 10 and 20.
2. An auto threshold feature was used to binarise the image and specifically to obtain clear resolution of the diamond and binder phases.
3. The binder was the primary phase of interest in the current analysis.
4. The software, having the trade name analySIS Pro from Soft Imaging System® GmbH (a trademark of Olympus Soft Imaging Solutions GmbH) was used and excluded from the analysis any particles which touched the boundaries of the image. This required appropriate choice of the image magnification:

a. If too low then resolution of fine particles is reduced.
b. If too high then:
i. Efficiency of coarse grain separation is reduced.
ii. High numbers of coarse grains are cut by the boarders of the image and hence less of these grains are analysed.
iii. Thus more images must be analysed to get a statistically-meaningful result.

5. Each particle was finally represented by the number of continuous pixels of which it is formed.
6. The AnalySIS software programme proceeded to detect and analyse each particle in the image. This can be automatically repeated for several images.
7. A large number of outputs was available. The outputs may be post-processed further, for example using statistical analysis software and/or carrying out further feature analysis, for example the analysis described below for determining the mean of the total binder area for all images and the means of the individual binder areas.

If appropriate thresholding is used, the image analysis technique is unlikely to introduce further errors in measurements which would have a practical effect on the accuracy of those measurements, with the exception of small errors related to the rounding of numbers. In the current analysis, the statistical mean values of the total binder area and individual binder areas were used as, according to the Central Limitation Theorem, the distribution of an average tends to be normal as the sample size increases, regardless of the distribution from which the average is taken except when the moments of the parent distribution do not exist. All practical distributions in statistical engineering have defined moments, and thus the Central Limitation Theorem applies in the present case. It was therefore deemed appropriate to use the statistical mean values.

The individual non-diamond (eg binder or catalyst/solvent) phase areas or pools, which are easily distinguishable from that of the super hard phase using electron microscopy, were identified using the above-mentioned standard image analysis tools. The total non-diamond phase areas (in square microns) in the analysed cross-sectional images were determined by summing the individual binder pool areas within the entire microstructural image area that was analysed.

The collected distributions of this data were then evaluated statistically and an arithmetic average was then determined. Hence the mean total binder pool area in the surface of the microstructure being analysed was calculated It is anticipated that microstructural parameters may alter slightly from one area of an abrasive compact to another, depending on formation conditions. Hence the microstructural imaging is carried out so as to representatively sample the bulk of the super hard composite portion of the compact.

Additional non-limiting examples are now described. Three sets of samples were produced as follows: a multimodal (trimodal) diamond powder mix with average diamond grain size of approximately 13 μm and 1 weight percent cobalt admix was prepared, in sufficient quantity to provide approximately 2 g admix per sample. The admix for each sample was then poured into or otherwise arranged in a Niobium inner cup. A cemented carbide substrate of approximately 13 weight percent cobalt content and having a non-planar interface was placed in each inner cup on the powder mix. A titanium cup was placed in turn over this structure and the assembly sealed to produce a canister. The canisters were pre-treated by vacuum outgassing at approximately 1050° C., and divided into three sets which were sintered at three distinct ultrahigh pressure and temperature conditions in the diamond-stable region, namely at approximately 5.5 GPa (Set 1), 6.8 GPa (Set 2), and 7.7 GPa (Set 3). Specifically the canisters were sintered at temperatures sufficient to melt the cobalt so as to produce PCD constructions with well-sintered PCD tables and well-bonded substrates. The technique described above in connection with FIGS. 3 to 9 was applied for the sintering of the canisters at 7.7 GPa (set 3). The resulting super hard constructions were not subjected to any post-synthesis leaching treatment.

Image analysis was then conducted on each of these super hard constructions using the techniques described above and in particular the determination of appropriate magnification described above to determine the mean total binder area in a polished cross-section and mean cross-sectional binder area for each sample.

The experiments may be repeated for different diamond grain size compositions and the results are set out in Table 1.

TABLE 1

| Grain Size microns | | Total Binder Area | Binder Area micron^2 | |
|---|---|---|---|---|
| Mean | StdDev | % | 0.01 | Magnification |
| 13.4600 | 2.2750 | 8.0699 | 0.4446 | 1000× |
| 12.5755 | 3.1707 | 8.0223 | 0.2802 | 1000× |
| 10.8800 | 1.8440 | 6.4004 | 0.2638 | 1000× |
| 3.9700 | 0.7990 | 10.3135 | 0.1528 | 3000× |

It was determined from the above experiments that, for a total non-diamond phase area (for example binder area) in the range of around 0 to 12%, it is possible to achieve an associated individual non-diamond area of less than around 0.7 micron$^2$, as determined using an image analysis technique applying a magnification of around 1000 and analysing an image area of 1280×960 pixels, with the largest dimension of the body of PCD material being around 6 mm or greater. The thickness of the body of PCD material in these embodiments may be, for example, around 0.3 mm or greater.

Furthermore, in some embodiments, for a total non-diamond phase area (for example binder area) in the range of around 0 to 12%, such as less than 12%, or less than 10% or less than 8%, it is possible to achieve an associated individual non-diamond area of less than around 0.7 micron$^2$, or less than around 0.5 micron$^2$, or less than around 0.4 micron$^2$, or less than around 0.34 micron$^2$, as determined using an image analysis technique applying a magnification of between around 1000 and analysing an image area of 1280×960 pixels, with the largest dimension of the body of PCD material being around 6 mm or greater. The thickness of the body of PCD material in these embodiments may be, for example, around 0.3 mm or greater.

To assist in improving thermal stability of the sintered structure, the catalysing material is removed from a region of the polycrystalline layer adjacent an exposed surface thereof, namely the working surface opposite the substrate. Removal of the catalysing material may be carried out using methods known in the art such as electrolytic etching, and acid leaching and evaporation techniques.

The polycrystalline super hard layer 22 to be leached by embodiments of the method may, but not exclusively, have a thickness of about 1.5 mm to about 3.5 mm.

It has been found that the removal of non-binder phase from within the PCD table, conventionally referred to as leaching, is desirable in various applications. The residual presence of solvent/catalyst material in the microstructural interstices is believed to have a detrimental effect on the performance of PCD compacts at high temperatures as it is believed that the presence of the solvent/catalyst in the diamond table reduces the thermal stability of the diamond table at these elevated temperatures. Therefore leaching is desired to enhance thermal stability of the PCD body. However, leaching solvent/catalyst material from a PCD structure is known to reduce its fracture toughness and strength by between 20 to 30%. The present applicants have surprisingly determined that, contrary to conventional expectations, leaching to a deeper leach depth and, in particular, leaching to a depth into the PCD body greater than the vertical height of the chamfer and with the length X defined above being in the range of 60% to 300% of the leach depth from the working surface, actually significantly increases the strength of the PCD body in terms of the pure mechanical strength in cutting applications and in strength in response to loading thereby retarding the likelihood of spalling. This is explained and illustrated with examples below.

In acid leaching, the reaction rate regarding leaching is considered to be dominated by the chemical rate initially as acid contacts a surface of the PCD table and later by the diffusion rate as the acid diffuses through the pores of the PCD table.

Conventionally, HF—$HNO_3$ has been shown to be the most effective media for the removal of tungsten carbide (WC) from the sintered PCD table. The problem with HF—$HNO_3$ is that it is volatile and, when heating this acid, specific technology, for example, gas sealing technology, is required. If such technology is not provided then the application of temperature will reduce the efficacy of HF—$HNO_3$ due to evaporation of the HF (which is poisonous) and formation of NO species, which are usually gaseous, and thus frequent replenishment of the acid media is required. Furthermore, heat would ordinarily be required to accelerate the leaching process in order to render the process commercially feasible. Another problem is that HF—$HNO_3$ is corrosive to most containment vessels making the reaction difficult to perform.

HCl and other similar mineral acids are easier to work with at high temperatures than HF—$HNO_3$ and are aggressive towards the catalyst/solvent, particularly cobalt (Co). HCl, for example, may remove the bulk of the catalyst/solvent from the PCD table in a reasonable time period, depending on the temperature, typically in the region of 80 hours, although it does not remove WC and it has been appreciated by the present applicant that HCl alone is not suitable for removing any non-diamond phase additions, such as VC from the PCD table.

To improve the performance and heat resistance of a surface of the body of PCD material 22, at least a portion of the metal-solvent catalyst, such as cobalt, and at least a portion of the additions to the PCD, such as carbide additions, may be removed from the interstices 14 of at least a portion of the PCD material 22. Additionally, tungsten and/or tungsten carbide may be removed from at least a portion of the body of PCD material 22.

Chemical leaching is used to remove the metal-solvent catalyst and the additions from the body of PCD material 22 up to a desired depth from the working surface 34 of the body of PCD material. Following leaching, the body of PCD material 22 comprises a first volume that is substantially free of a metal-solvent catalyst. However, small amounts of catalyst may remain within interstices that are inaccessible to the leaching process. Following leaching, the body of PCD material 22 also comprises a volume that contains a metal-solvent catalyst. In some embodiments, this further volume may be remote from one or more exposed surfaces of the body of PCD material 22.

The interstitial material which may include, for example, the metal-solvent/catalyst and one or more additions in the form of carbide additions, may be leached from the interstices 14 in the body of PCD material 22 by exposing the PCD material to a suitable leaching solution.

According to some embodiments, the leaching solution may comprise one or more mineral acids and diluted nitric acid. The body of PCD material may be exposed to such a leaching solution in any suitable manner, including, for example, by immersing at least a portion of the body of PCD material 22 in the leaching solution for a period of time.

According to some embodiments, the body of PCD material may be exposed to the leaching solution at an elevated temperature, for example to a temperature at which the acid leaching mixture is boiling. Exposing the body of PCD material to an elevated temperature during leaching may increase the depth to which the PCD material may be leached and reduce the leaching time necessary to reach the desired leach depth.

When only a portion of the body of PCD material is to be leached, the body, and if it is still attached to the substrate, the substrate may be at least partially surrounded by a protective layer to prevent the leaching solution from chemically damaging certain portions of the body of PCD material and/or the substrate attached thereto during leaching. Such a configuration may provide selective leaching of the body of PCD material, which may be beneficial. Following leaching, the protective layer or mask may be removed.

Additionally, in some embodiments, at least a portion of the body of PCD material and the leaching solution may be exposed to at least one of an electric current, microwave radiation, and/or ultrasonic energy to increase the rate at which the body of PCD material is leached.

Examples of suitable mineral acids may include, for example, hydrochloric acid, phosphoric acid, sulphuric acid, hydrofluoric acid, and/or any combination of the foregoing mineral acids.

In some embodiments, nitric acid may be present in the leaching mixture of some embodiments in an amount of, for example, between 2 to 5 wt % and/or a molar concentration of up to around 1.3M. In some embodiments, one or more mineral acids may be present in the leaching solution at a molar concentration of up to around, for example, 7M.

In some embodiments, the PCD table was leached using a solution comprising hydrochloric acid and nitric acid diluted in water. The PCD table was leached for between around 30 to 300 hours, depending on desired leach depth and composition of the PCD material, at a temperature at which the acid leaching mixture was boiling and ultrasound was applied after a period of leaching to remove remnant reactants.

After leaching, leached depths of the PCD table were determined for various portions of the PCD table, through conventional x-ray analysis.

In order to test the wear resistance of the sintered polycrystalline products formed according to the above methods and leached to various leach depths, a first example product (Example 1) comprising a bimodal mixture of 70 weight percent of diamond grains having an average grain size of 17 microns, and 30 weight percent of diamond grains having an average grain size of 1.7 microns was sintered at a sintering pressure of 6.8 GPa. The sintered products were leached for a sufficient leach time (from around 40 hours for a leach depth of around 250 microns and around 100 hours for a leach depth of around 1000 microns) to produce, for comparison, a leached product having a leach depth from the working surface of 256 microns, a further product having a leach depth of 572 microns and a further product having a leach depth of 947 microns.

Figure 12:
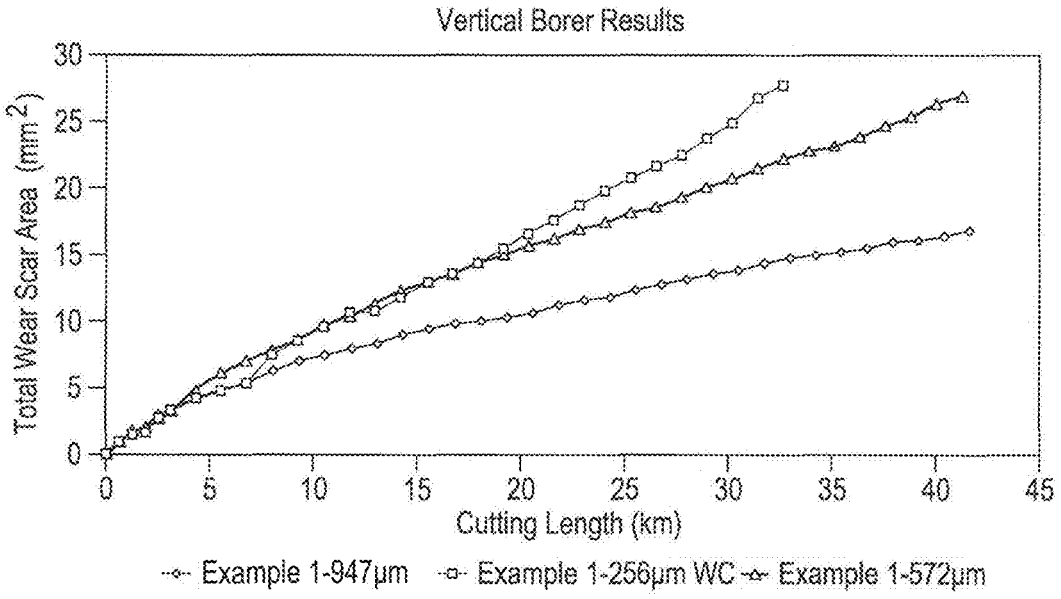
FIG. 12 is a plot of wear scar area against cutting length in a vertical borer test for an embodiment.

The diamond layers were then polished and a subjected to a vertical boring mill test. In this test, the wear flat area was measured as a function of the number of passes of the cutter element boring into the workpiece. The results obtained are illustrated graphically in FIG. 12. The results provide an indication of the total wear scar area plotted against cutting length.

It will be seen that the PCD compacts formed according to Example 1 were able to achieve a significantly greater cutting length and smaller wear scar area at leach depths of 572 microns and 947 microns than that leached to 256 microns.

A further example set of polycrystalline compacts were produced according to the above described methods and form Example 2, these compacts were comprised of a trimodal mixture of 40 weight percent of diamond grains having an average grain size of 17 microns, 30 weight percent of diamond grains having an average grain size of 10 microns and 30 weight percent of diamond grains having an average grain size of 1.7 microns. The sintering pressure was 7.1 GPa.

The sintered products were leached for a sufficient leach time (from around 230 hours for a leach depth of around 700 microns and around 250 hours for a leach depth of around 900 microns) to produce, for comparison, a leached product having a leach depth from the working surface of 971 microns, and a further product having a leach depth of 770 microns.

Figure 13:
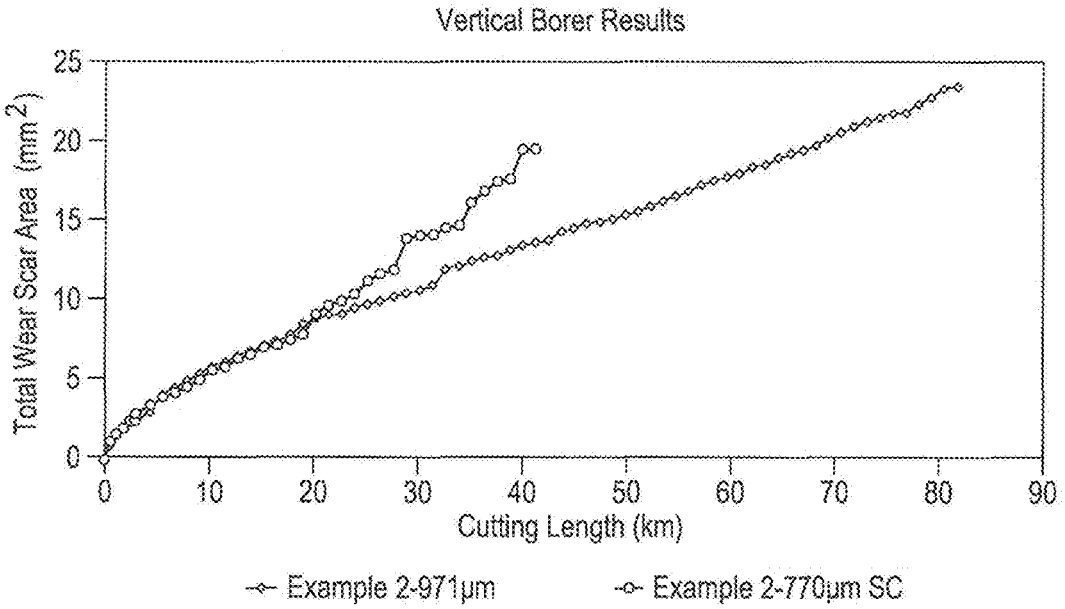
FIG. 13 is a plot of wear scar area against cutting length in a vertical borer test for another embodiment.

The diamond layers were then polished and a subjected to a vertical boring mill test. The results obtained are illustrated graphically in FIG. 13.

It will be seen that the PCD compacts formed according to Example 2 were able to achieve a significantly greater cutting length and smaller wear scar area at leach depths of 971 microns than that leached to 770 microns.

Whilst not wishing to be bound by a particular theory, using the conditions described herein it was determined possible to achieve a mechanically stronger and more wear-resistant body of PCD material which, when used as a cutter, may significantly enhance the durability of the cutter produced according to some embodiments described herein.

Indeed, in particular, whilst leaching is desired to enhance thermal stability of the PCD body it is known that leaching solvent/catalyst material from a PCD structure reduces its fracture toughness and strength by between 20 to 30%. The present applicants have appreciated that, contrary to conventional expectations, leaching to a deeper leach depth and, in particular, leaching to a depth into the PCD body and, in particular, leaching to a depth into the PCD body greater than the vertical height of the chamfer and with the length X defined above being in the range of 60% to 300% of the leach depth from the working surface, actually significantly increases the strength of the PCD body in terms of the pure mechanical strength in cutting applications and in strength in response to loading thereby retarding the likelihood of spalling when compared to PCD bodies leached to depths of less than 450 microns. This may be assisted by maintaining the wear scar in use in the leached PCD layer thereby inhibiting the effects of cracks propagating along the interface between the leached and unleached regions of PCD. These serve to reduce the likelihood or frequency of spalling and therefore increasing the useful working life of the PCD construction.

It has also been found that the multimodal distributions of some embodiments may assist in achieving a very high degree (density) of diamond intergrowth while still maintaining sufficient open porosity to enable efficient leaching.

While various embodiments have been described with reference to a number of examples, those skilled in the art will understand that various changes may be made and equivalents may be substituted for elements thereof and that these examples are not intended to limit the particular embodiments disclosed.

In addition, various arrangements and combinations are envisaged for the method by the disclosure, and examples of the method may further include one or more of the following non-exhaustive and non-limiting aspects in various combinations.

There may be provided a method for making a super-hard construction comprising:

a first structure joined to a second structure, the first structure comprising first material having a first coefficient of thermal expansion (CTE) and a first Young's modulus, and the second structure comprising second material having a second CTE and a second Young's modulus; the first CTE and the second CTE being substantially different from each other and the first Young's modulus and the second Young's modulus being substantially different from each other; at least one of the first or second materials comprising super-hard material; the method including:

forming an assembly comprising the first material, the second material and a binder material arranged to be capable of bonding the first and second materials together, the binder material comprising metal; subjecting the assembly to a sufficiently high temperature for the binder material to be in the liquid state and to a first pressure at which the super-hard material is thermodynamically stable; reducing the pressure to a second pressure at which the super-hard material is thermodynamically stable, the temperature being maintained sufficiently high to maintain the binder material in the liquid state; reducing the temperature to solidify the binder material; and reducing the pressure and the temperature to an ambient condition to provide the super-hard construction.

In some embodiments, the CTE of one of the first or second materials is at least about 2.5×10-6 per degree Celsius and at most about 5.0×10-6 per degree Celsius and the CTE of the other of the first or second materials is at least about 3.5×10-6 per degree Celsius and at most about 6.5×10-6 per degree Celsius, at about 25 degrees Celsius.

In some embodiments, the Young's modulus of one of the first or second materials is at least about 500 gigapascals and at most about 1,300 gigapascals and the Young's modulus of the other of the first and second materials is at least about 800 gigapascals and at most about 1,600 gigapascals.

The Young's moduli of the first and second materials may, for example, differ by at least about 10%.

In some embodiments, the CTE of the first and second materials may, for example, differ by at least about 10%.

The method may further include sintering an aggregation of a plurality of grains of the super-hard material in the presence of sinter catalyst material at a sinter pressure and a sinter temperature to form the second structure.

The method may include disposing an aggregation of grains of super-hard material adjacent the first structure and in the presence of the binder material to form a pre-sinter assembly; subjecting the pre-sinter assembly to a sinter pressure and a sinter temperature to melt the binder material and sinter the grains of super-hard materials and form the second structure comprising polycrystalline super-hard material connected to the first structure by the binder material in the molten state.

In some embodiments, the first pressure is substantially the sinter pressure.

The method may further include providing the first structure, providing the second structure comprising polycrystalline super-hard material, disposing the first structure adjacent the second structure and forming a pre-construction assembly, and applying a pressure to the pre-construction assembly, increasing the pressure from ambient pressure to the first pressure.

The method may, for example, include subjecting an aggregation of a plurality of grains of super-hard material to a sinter pressure and a sinter temperature at which the super-hard material is capable of being sintered to form the second material, and reducing the pressure and temperature to an ambient condition to provide the second structure; the first pressure being substantially greater than the sinter pressure.

The second structure may comprise diamond material and the binder material comprises catalyst material for diamond.

The first and second structures may each comprise diamond material and the binder material comprises catalyst material for diamond.

In some embodiments, the difference between the second pressure and the first pressure is at least about 0.5 gigapascal.

The method may further include subjecting the super-hard construction to further heat treatment at a treatment temperature and a treatment pressure at which the super-hard material is thermodynamically meta-stable.

The super-hard material may comprise diamond material and the treatment temperature is at least about 500 degrees Celsius and the treatment pressure is less than about 1 gigapascal.

The method may include the step of reducing the pressure from the first pressure to an intermediate pressure for an holding period, and then further reducing the pressure from the intermediate pressure to the second pressure.

The first pressure may, for example, be at least about 7 gigapascal, the intermediate pressure may be, for example, at least about 5.5 gigapascals and less than about 10 gigapascals, the holding period may, for example, be at least about 1 minute and the second pressure may, for example, be at least about 5.5 gigapascals and at most about 7 gigapascals.

The pressure at which the binder material begins to solidify responsive to the reduction in temperature may, for example, be substantially equal to the second pressure in some embodiments.

In other embodiments, the pressure at which the binder material begins to solidify responsive to the reduction in temperature may be substantially less than the second pressure.

In some embodiments, the first structure comprises cobalt-cemented tungsten carbide material and the second material comprises PCD material, the CTE of the cemented carbide material being in the range of about 4.5×10-6 to about 6.5×10-6 per degree Celsius, the CTE of the PCD material being in the range of about 3.0×10-6 to about 5.0×10-6 per degree Celsius; the Young's modulus of the cemented carbide material being in the range of about 500 to about 1,000 gigapascals, and the Young's modulus of the PCD material being in the range of about 800 to about 1,600 gigapascals; the first pressure being in the range of about 6 to about 10 gigapascals, and the second pressure being in the range of about 5.5 to about 8 gigapascals.

In some embodiments, the pressure at which the cobalt-based binder material comprised in the cemented carbide material begins to solidify is equal to the second pressure.

The second pressure may, for example, be in the range of about 6.5 to about 7.5 gigapascals.

In some embodiments, the second structure comprises PCD material and the method includes subjecting the super-hard construction to further heat treatment for a treatment period in the range of about 30 to about 90 minutes at a treatment temperature in the range of about 550 to about 650 degrees Celsius.

The invention claimed is:

1. A polycrystalline super hard construction comprising a body of polycrystalline diamond (PCD) material and a plurality of interstitial regions between inter-bonded diamond grains forming the polycrystalline diamond material; the body of PCD material comprising:

a working surface positioned along an outside portion of the body;

a first region substantially free of a solvent/catalysing material; the first region extending a depth from the working surface into the body of PCD material along a plane substantially perpendicular to the plane along which the working surface extends; and a second region remote from the working surface that includes solvent/catalysing material in a plurality of the interstitial regions;

a substrate attached to the body of PCD material along an interface with the second region;

a chamfer extending between the working surface and a peripheral side surface of the body of PCD material and defining a cutting edge at the intersection of the chamfer and the peripheral side surface; the chamfer having a height, the height being the length along a plane perpendicular to the plane along which the working surface extends between the point of intersection of the chamfer with the working surface and the point of intersection of the chamfer and the peripheral side surface of the body of PCD material; wherein:

the depth of the first region is greater than the height of the chamfer; and wherein a first length along a plane extending from the point of intersection of the chamfer and the peripheral side surface of the PCD body at an angle of between around 65 to 75 degrees to the interface between the first and second regions is between around 60% to around 300% of the depth of the first region;

wherein the first region comprises a total diamond fraction comprising a first fraction of diamond grains and a second fraction of diamond grains, the first fraction having an average grain size of between 10 to 60 microns, the second fraction having an average grain size of between 0.1 to 20 microns, wherein the total diamond fraction of the first region comprises between 50% to 97% of the first fraction and between 3% to 50% of the second fraction; and wherein the first region extends across only a part of the working surface.

2. The polycrystalline super hard construction of claim 1, wherein a majority of the diamond grains in the body within at least a depth of 400 microns from the working surface have a surface which is substantially free of catalyzing material, the remaining grains contacting catalyzing material.

3. The polycrystalline super hard construction of claim 1, wherein the depth of the first region is greater than the first length.

4. The polycrystalline super hard construction of claim 1, wherein the first region extends across the whole of the working surface.

5. The polycrystalline super hard construction of claim 4, wherein the first region extends across the working surface in a region a radial distance of between around 2 to 6 mm from the intersection of the working surface with the chamfer.

6. The polycrystalline super hard construction of claim 1, wherein the first and/or second regions comprise diamond grains of two or more diamond grain sizes.

7. The polycrystalline super hard construction of claim 6, wherein the diamond grains have an associated mean free path; the solvent/catalyst at least partially filling a plurality of the interstitial regions in the second region having an associated mean free path;

wherein:

the median of the mean free path associated with the solvent/catalyst divided by (Q3−Q1) for the solvent/catalyst is greater than or equal to 0.5, where Q1 is the first quartile and Q3 is the third quartile; and the median of the mean free path associated with the diamond grains divided by (Q3−Q1) for the diamond grains is less than 0.6.

8. The polycrystalline super hard construction of claim 7, wherein the median of the mean free path associated with the solvent/catalyst divided by (Q3−Q1) for the solvent/catalyst is greater than or equal to 0.6.

9. The polycrystalline super hard construction of claim 7, wherein the median of the mean free path associated with the solvent/catalyst divided by (Q3−Q1) for the solvent/catalyst is greater than or equal to 0.8.

10. The polycrystalline super hard construction of claim 7, wherein the median of the mean free path associated with the solvent/catalyst divided by (Q3−Q1) for the solvent/catalyst is greater than or equal to 0.83.

11. The polycrystalline super hard construction of claim 7, wherein the median of the mean free path associated with the diamond grains divided by (Q3−Q1) for the diamond grains is less than 0.5.

12. The polycrystalline super hard construction of claim 7, wherein the median of the mean free path associated with the diamond grains divided by (Q3−Q1) for the diamond grains is less than 0.47.

13. The polycrystalline super hard construction of claim 7, wherein the median of the mean free path associated with the diamond grains divided by (Q3−Q1) for the diamond grains is less than 0.4.

14. A polycrystalline super hard construction according to claim 1, wherein the catalyst/solvent at least partially filling a plurality of the interstitial regions forms non-diamond phase pools, the non-diamond phase pools each having an individual cross-sectional area, wherein the percentage of catalyst/solvent in the total area of a cross-section of the body of polycrystalline diamond material is between around 0 to 12%, and the mean of the individual cross-sectional areas of the non-diamond phase pools in an analysed image of a cross-section through the body of polycrystalline material is less than around 0.7 microns squared when analysed using an image analysis technique at a magnification of around 1000 and an image area of 1280 by 960 pixels.

15. A polycrystalline super hard construction according to claim 14, wherein the percentage of catalyst/solvent in the total area of a cross-section of the body of polycrystalline diamond material is between around 0 to 10%, and the mean of the individual cross-sectional areas of the non-diamond phase pools in an analysed image of a cross-section through the body of polycrystalline material is less than around 0.7 microns squared when analysed using an image analysis technique at a magnification of around 1000 and an image area of 1280 by 960 pixels.

16. A polycrystalline super hard construction according to claim 14, wherein the percentage of catalyst/solvent in the total area of a cross-section of the body of polycrystalline diamond material is between around 0 to 8%, and the mean of the individual cross-sectional areas of the non-diamond phase pools in an analysed image of a cross-section through the body of polycrystalline material is less than around 0.7 microns squared when analysed using an image analysis technique at a magnification of around 1000 and an image area of 1280 by 960 pixels.

17. A polycrystalline super hard construction according to claim 14, wherein the mean of the individual cross-sectional areas of the non-diamond phase pools in an analysed image of a cross-section through the body of polycrystalline material is less than around 0.5 microns squared when analysed using an image analysis technique at a magnification of around 1000 and an image area of 1280 by 960 pixels.

18. A polycrystalline super hard construction according to claim 14, wherein the mean of the individual cross-sectional areas of the non-diamond phase pools in an analysed image of a cross-section through the body of polycrystalline material is less than around 0.4 microns squared when analysed using an image analysis technique at a magnification of around 1000 and an image area of 1280 by 960 pixels.

19. A polycrystalline super hard construction according to claim 14, wherein the mean of the individual cross-sectional areas of the non-diamond phase pools in an analysed image of a cross-section through the body of polycrystalline material is less than around 0.34 microns squared when analysed using an image analysis technique at a magnification of around 1000 and an image area of 1280 by 960 pixels.

20. A polycrystalline super hard construction according to claim 1, wherein the first length is between around 70% to around 200% of the depth of the first region.

21. The polycrystalline super hard construction of claim 4, wherein the first region extends across the working surface in a region a radial distance of between around 3 to 4 mm from the intersection of the working surface with the chamfer.

* * * * *